US006978758B2

(12) United States Patent
Elmer

(10) Patent No.: US 6,978,758 B2
(45) Date of Patent: Dec. 27, 2005

(54) HIGH EFFICIENCY ROTARY PISTON COMBUSTION ENGINE

(76) Inventor: Brent Warren Elmer, 1301 Chestnut Ave., Trenton, NJ (US) 08611

( * ) Notice: Subject to any disclaimer, the term of this patent is extended or adjusted under 35 U.S.C. 154(b) by 279 days.

(21) Appl. No.: 10/456,168

(22) Filed: Jun. 6, 2003

(65) Prior Publication Data

US 2004/0244765 A1 Dec. 9, 2004

(51) Int. Cl.[7] ..... F02B 53/04; F02B 53/00; F01C 1/00

(52) U.S. Cl. ..... 123/236; 123/237; 123/243; 123/245; 418/266

(58) Field of Search ..... 123/236, 237, 123/205, 210, 244, 245, 243, 216, 234, 44 D; 60/670, 39.5–39.6; 418/266

(56) References Cited

U.S. PATENT DOCUMENTS

| | | | | |
|---|---|---|---|---|
| 362,194 A | | 5/1887 | Van Tine | |
| 733,773 A | | 7/1903 | Vogan et al. | 418/266 |
| 861,164 A | | 7/1907 | Cummings | 418/266 |
| 1,421,632 A | * | 7/1922 | Wedig | 60/39.5 |
| 1,757,484 A | * | 5/1930 | Shoemaker | 123/236 |
| 2,472,014 A | * | 5/1949 | Heald | 60/39.55 |
| 2,827,881 A | * | 3/1958 | Zumbusch | 418/266 |
| 3,150,646 A | | 9/1964 | Bernard | 123/231 |
| 3,196,856 A | * | 7/1965 | Ward | 418/266 |
| 3,227,145 A | | 1/1966 | Bernard | 123/231 |
| 3,240,017 A | * | 3/1966 | Boissevain et al. | 123/234 |
| 3,240,189 A | | 3/1966 | Stümpfig | |
| 3,267,675 A | * | 8/1966 | Gesell | 60/39.6 |
| 3,373,723 A | * | 3/1968 | Blosser | 123/216 |
| 3,626,265 A | | 12/1971 | Kraakman | 418/226 |
| 3,871,799 A | | 3/1975 | Vogt et al. | 418/226 |
| 3,886,913 A | * | 6/1975 | Blanchard | 123/44 D |
| 3,976,036 A | | 8/1976 | Muroki et al. | |
| 4,040,391 A | | 8/1977 | Zeilinger | |
| 4,055,155 A | | 10/1977 | Kono | |
| 4,078,529 A | | 3/1978 | Warwick | |
| 4,089,305 A | | 5/1978 | Gregg | 123/244 |
| 4,096,828 A | | 6/1978 | Satou et al. | |
| 4,261,184 A | | 4/1981 | Stout | |

(Continued)

FOREIGN PATENT DOCUMENTS

| | | | | |
|---|---|---|---|---|
| DE | 3128309 A1 | * | 2/1983 | F01C 11/00 |
| JP | 01080723 A | * | 3/1989 | F02B 53/10 |

OTHER PUBLICATIONS

"Merger Of Jet And IC Engine Technology," Popular Mechanics, Apr. 2004, p. 30.

*Primary Examiner*—Thai-Ba Trieu
(74) *Attorney, Agent, or Firm*—Kenneth Watov; Watov & Kipnes, P.C.

(57) ABSTRACT

A computer controlled rotary piston engine includes a blower housing containing a rotatable impeller assembly, for pushing ambient air into the housing, and forcing the air to pass through a normally open valve mechanism into a combustion chamber. A plurality of fuel injectors are selectively operable for injecting fuel into the combustion chamber, followed by selective operation of at least one spark plug for igniting the fuel/air mixture, thereby causing the valve mechanism to close, and the combustion gases to pass through a plurality of spaced apart intake manifolds into always open input ports of a piston chamber for rotating a vaned or bladed rotary piston therein, followed by spent combustion gases being forced out of a plurality of spaced always open exhaust ports into an exhaust manifold. The distance the piston travels during a power cycle is adjustable, and inversely proportional to the frequency of combustion or number of combustion cycles within a given period of time.

23 Claims, 16 Drawing Sheets

U.S. PATENT DOCUMENTS 4,449,488 A * 5/1984 Heaton ..... 123/46 R
4,454,844 A * 6/1984 Kinsey ..... 123/236
4,572,122 A 2/1986 Kamai et al.
4,599,059 A 7/1986 Hsu
5,372,107 A 12/1994 Smythe
5,410,998 A * 5/1995 Paul et al. ..... 123/204
5,423,297 A * 6/1995 Roberts ..... 123/236
5,596,963 A * 1/1997 Lai ..... 123/236
5,720,251 A 2/1998 Round et al.
5,758,501 A * 6/1998 Jirnov et al. ..... 60/670
6,250,279 B1 6/2001 Zack
6,347,611 B1 * 2/2002 Wright ..... 123/237
6,370,864 B1 4/2002 Murphy ..... 60/39.15
6,530,357 B1 3/2003 Yaroshenko ..... 123/244
6,698,395 B1 * 3/2004 Vasilantone ..... 123/243
6,772,728 B2 * 8/2004 Al-hawaj ..... 123/236
6,895,923 B1 * 5/2005 Jones ..... 123/245
2004/0009443 A1 * 1/2004 Loving ..... 431/19
2004/0128974 A1 * 7/2004 Laper ..... 60/39.6
2005/0005898 A1 * 1/2005 Horstin ..... 123/236

* cited by examiner

HIGH EFFICIENCY ROTARY PISTON COMBUSTION ENGINE

FIELD OF THE INVENTION

The invention relates generally to internal combustion engines, and more particularly to internal combustion engines that employ a rotary piston that continuously rotates in driving a drive shaft.

BACKGROUND OF THE INVENTION

As is well known in the art, typical internal combustion piston engines are highly inefficient during operation. For example, if you end a power cycle for a four cycle engine, the exhaust valve must be held open when its associated piston reaches bottom dead center. Various studies have estimated that such operation causes more than fifty percent of the power generated by the combustion of fuel in the engine to be lost. By providing a longer power cycle for each piston of the engine, it is theoretically possible to improve efficiency. However, because of the requirement of mechanical timing, and the requirement that exhaust and intake valves are typically mechanically opened and closed, the provision of longer power cycles is very limited, in that the distance a reciprocating piston travels between spark plug ignitions of the fuel/air mixture or between combustion cycles is substantially fixed, in turn, limiting gains in efficiency. Greater efficiencies can be obtained by employing a piston that rotates repetitively in a circle, thereby avoiding the reciprocal motion of the pistons in a typical internal combustion engine.

Rotary engines known in the art employ electronic controllers for controlling ignition and fuel injection. For example, in Warwick U.S. Pat. No. 4,078,529, entitled "Rotary Engine," such electronic control is utilized. Also, ignition timing is controlled through use of magnets that rotate in unison with a rotary piston for generating an electric pulse in a stationary coil as they pass the coil, whereby the pulses are amplified and utilized for triggering an electronic or capacitor discharge ignition system. However, the rotating cylinder block of this engine employs a plurality of reciprocating pistons. As a result, inlet and outlet ports must be opened and a closed at appropriate times during operation of the engine. Also, fuel combustion occurs within the piston chamber. Accordingly, the length of the power stroke of a piston, that is the length of the power cycle cannot be adjusted or varied relative to load conditions.

Satou et al., U.S. Pat. No. 4,096,828, entitled "Rotary Piston Internal Combustion Engine," teaches a Wankel type engine that employs a first combustion chamber for the initial combustion of fuel from which the partially combusted air/fuel mixture is passed into the piston chamber also serving as a second combustion chamber in which additional fuel is mixed with air and ignited during the combustion cycle. Air is provided to the engine through a first port, and spent combustion products are ejected from a second port. A similar arrangement is taught in Muroki et al., U.S. Pat. No. 3,976,036, entitled "Rotary Piston Engines." Such engine configurations substantially fix the distance a piston travels during a power cycle.

In Stumpfig, U.S. Pat. No. 3,240,189, entitled "Rotary Piston Combustion Apparatus," a rotary piston is provided in a number of embodiments that employs the use of regularly extending vanes or separating elements which are moveable toward the inside wall surfaces of the piston chamber case or housing. The vanes extend and retract regularly as the piston rotates. Air is drawn into one portion of the piston chamber from a single inlet port, and spent combustion products are exhausted from a single exhaust port as the piston is rotated. Fuel is ignited in an evaporation chamber via a spark plug, and the ignited fuel is passed into the piston chamber for further mixing with air for completing the combustion thereof. As indicated such an engine configuration provides a fixed distance for piston travel during a power cycle.

SUMMARY OF THE INVENTION

With the problems in the prior art in mind, an object of the invention is to provide an improved rotary engine.

Another object of the invention is to provide a high-efficiency rotary engine.

Another object of the invention is to provide a rotary engine that does not require mechanically or electromechanically operated intake and exhaust valve mechanisms in the rotary piston chamber.

Yet another embodiment of the invention is to provide an improved rotary engine of simplified design.

Another embodiment of the invention is to provide an improved rotary engine with computerized control for its operation.

These and other objects of the invention are provided in one embodiment by connecting together on a common drive shaft a blower or fan housing coupled to one end of an independent combustion chamber, with the other end of the combustion chamber coupled to a rotary piston chamber. The blower housing includes rotatable impeller means for drawing in air and forcing it under relatively low compression through a valving means between the blower housing and combustion chamber, into the combustion chamber. A plurality of injectors are selectively operable for injecting fuel into the combustion chamber for mixing with the air, whereafter at the appropriate time at least one of a plurality of spark plugs is energized for igniting the fuel/air mixture. Upon combustion of the fuel/air mixture, the pressure developed by the combustion gases is responded to by the valve means for closing off the flow of air from the impeller means into the combustion chamber, and further for causing the expansive gaseous combustion products to travel through a plurality of intake manifolds into the chamber of a rotary piston housing, for pushing against blades or vanes of a rotary piston therein to cause it to rotate. A computerized control system operates the fuel injectors and spark plugs as required for maintaining rotation of the shaft at a desired speed and with a required power output at all times during operation of the rotary engine. The plurality of intake and exhaust ports are successively equally spaced about the circumference of the piston chamber housing, which ports are always open to respective intake and exhaust manifold sections, thereby permitting rapid entry of combustion gases into the piston chamber, and rapid exhaust of spent combustion products from the piston chamber as the rotary piston rotates. The combustion chamber includes deflector means for directing combustion gases from the combustion chamber into an intake manifold for delivery to the piston chamber intake ports. A plurality of sensor means are included for providing data signals to the computer control system indicative of shaft speed, internal air pressure in the blower housing, and internal pressure in the combustion chamber, whereby the computerized controller is programmed to use the monitored data from the sensor means in combination with throttle and/or power demand signals, for example, for producing appropriate control signals to energize the injectors and spark plugs at appropriate times for maintaining required operation of the engine.

In one embodiment of the invention look-up table means are used for providing the control signals based upon the combination of sensor signals from the engine, and requested engine speed and power requirements at any given time. Also, purge valve means are operable for insuring the complete exhaustion of combustion gases from the combustion chamber at the end of a combustion cycle to enhance high speed operation of the rotary engine. The length of the power stroke or power cycle is inversely proportional to the number of combustion cycles within a given period of time. The shorter the power stroke or distance the piston travels between combustion cycles the greater the power output. The efficiency of the engine is maximized through control of the distance the piston travels for each power stroke.

BRIEF DESCRIPTION OF THE DRAWINGS

Various embodiments of the present invention are described with reference to the drawings, in which like items are indicated by the same reference designation, wherein.

DETAILED DESCRIPTION OF THE INVENTION

Figure 1:
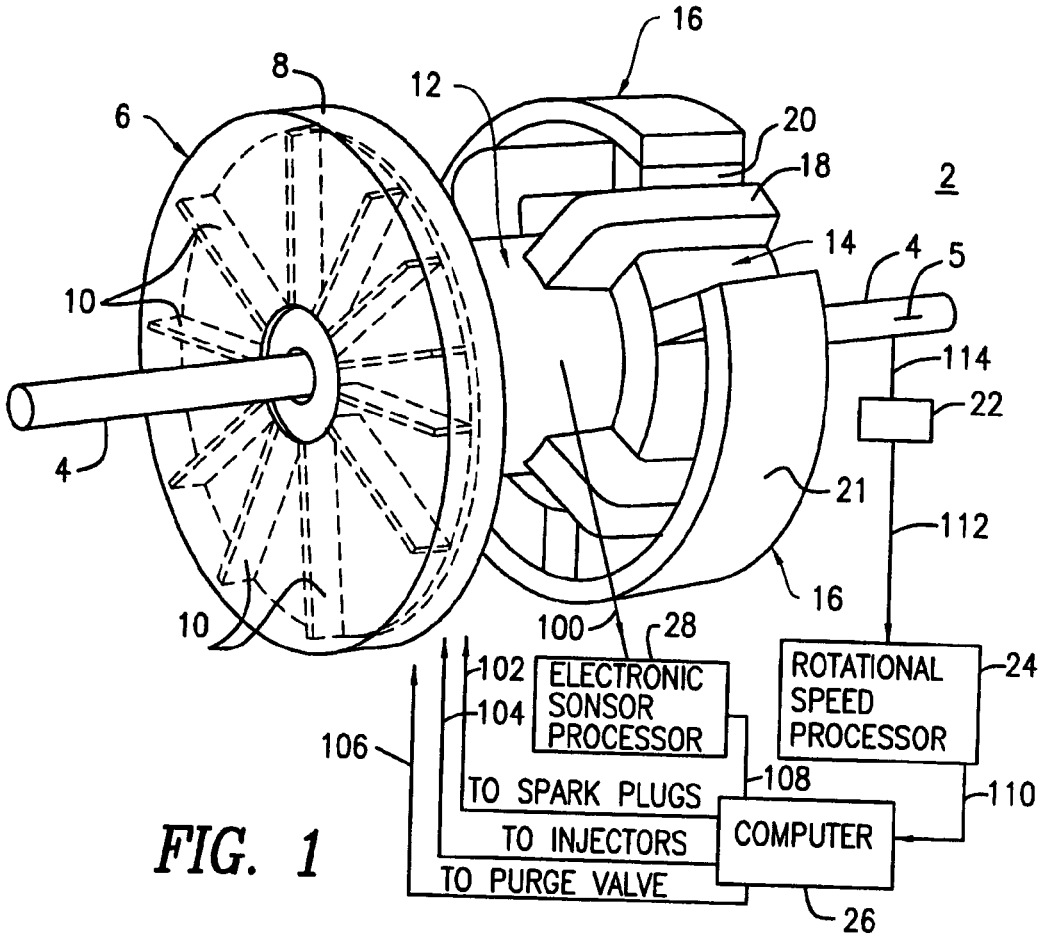
FIG. 1 is a perspective view of the rotary piston engine looking toward a blower or fan housing, for one embodiment of the invention.
Figure 2:
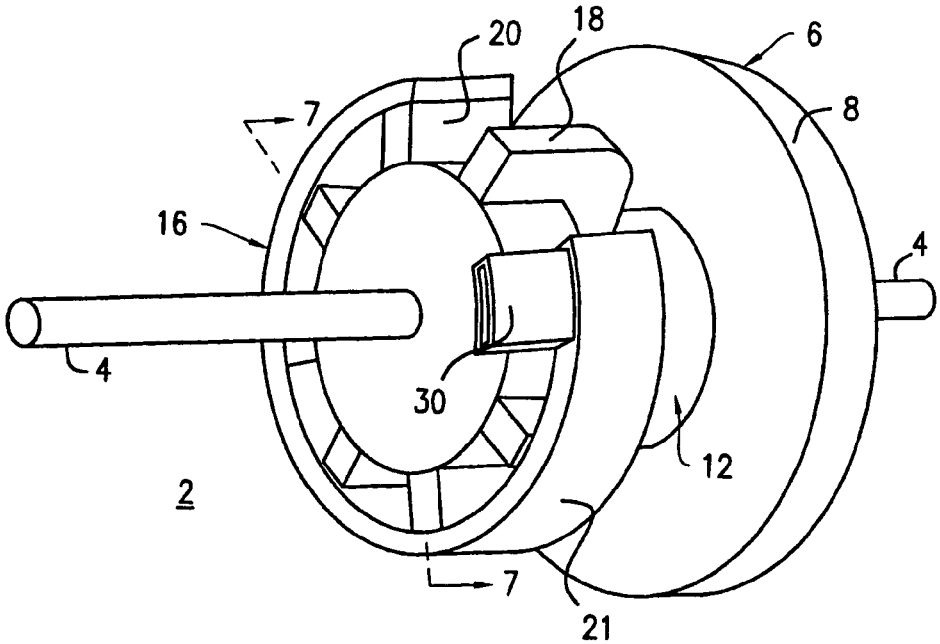
FIG. 2 is a perspective view of the rotary engine of FIG. 1 looking toward a rotary piston housing surrounded by intake and exhaust manifold couplings.

A pictorial view of the present rotary engine is shown in FIGS. 1 and 2 for a number of embodiments. More particularly, a drive shaft 4 is common to all portions of the rotary engine 2. The front portion of the engine 2 includes a fan or blower 6 that includes a housing 8 substantially enclosing a plurality of spaced apart impeller or fan blades 10, the latter being rigidly connected to a portion of the drive shaft 4, as will be explained in further detail below. As a result, in this embodiment the fan 6 is mechanically driven by drive shaft 4. However, in an alternative embodiment the fan is driven by an electric motor. The fan 6 is connected coaxially to one end of a combustion chamber 12, the other end of which is connected coaxially to a piston chamber 14, in this example. The piston chamber 14 encloses a rotary piston 15 in which a plurality of spring biased vanes 38 are installed. A manifold assembly 16 includes a plurality of equally spaced apart intake manifolds 18 connected between holes 19 in the combustion chamber 12 and input ports 36 of the piston chamber 14 (see FIGS. 13 and 14); and a plurality of equally spaced apart exhaust manifolds 20 connected between the piston chamber 14 and an exhaust manifold ring 21. An exhaust duct 30 is provided on an outside sidewall of the exhaust manifold ring 21 proximate one end thereof, as shown in FIG. 2.

A transducer 22 is connected either mechanically or optically via a connection generally shown as 114 for detecting the speed of the drive shaft 4 at any given time. Transducer 22 can be provided by any suitable transducer for providing the speed of a motorized drive shaft. A laser optical pickup can provide the functions of transducer 22, for example. Output signals from the transducer 22 are transferred via signal line 112 to a rotational speed processor 24, which processes the speed and distance signals into digitized signals for connection via data line 110 to a computer 26, as shown. In one embodiment, datum marks 5 are permanently placed one-half a degree apart on drive shaft 4 (see FIG. 1 showing one such datum mark 5), for example. Transducer 22 is positioned for sensing the passing of datum marks 5 at the initiation of a combustion or power cycle for counting the number of datum marks 5 to determine the distance the piston 15 has traveled over a given period of time analogous to a desired power cycle, after which time another combustion or power cycle may be immediately initiated or may be initiated some time later, depending upon the power and speed requirements at the time.

Electronic sensors 28, such as known and appropriate electro optical or electromechanical sensors are included for providing signals indicative of the air pressure and temperature in the fan housing 8, and the pressure and temperature in the combustion chamber 12, as will be discussed below in greater detail. In FIG. 1, a signal cable 100 is generally shown for connecting the output signals from the sensors to electronic sensor processor unit 28 for processing these signals into digitized signals appropriate for connection via electrical cable 108 to computer 26. A control line 116 is connected to computer 26 for providing control signals indicative of the power and speed required from the engine 2 at any given time. For example, the control signals provided on control signal line 116 may be derived from the throttle mechanism of an automobile.

Figure 3:
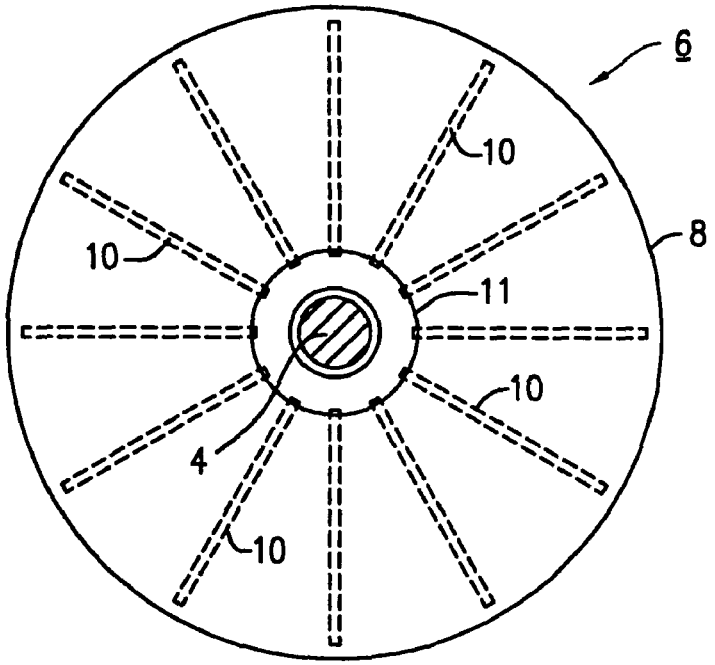
FIG. 3 is a front elevational view of the rotary piston engine.
Figure 4:
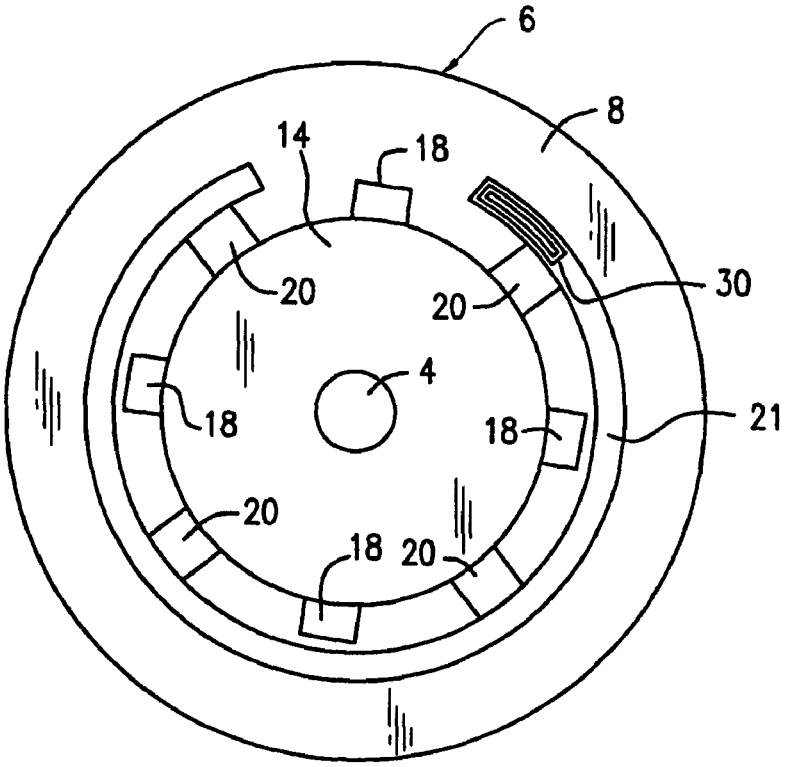
FIG. 4 is a rear elevational view of the rotary piston engine.

The various sections of the engine are made from appropriate materials as would be known to those of skill in the art. Note further the front elevational view of the present rotary engine 2 as shown in FIG. 3, and the rear elevational view as shown in FIG. 4.

The computer 26 is programmed to drive appropriate spark ignition apparatus (not shown) via cable 102 to fire appropriate ones of a plurality of spark plugs 48, and via another control line 104 for operating injectors 46 to inject fuel (gasoline in this example) into combustion chamber 12 at appropriate times (see FIGS. 7A, 7B, 12–14). A purge valve signal line 106 is also provided to apply a control signal from computer 26 to a purge valve 50 (see FIGS. 7A, 7B, 13, and 14) for purging combustion products from combustion chamber 12 as required.

Figure 5:
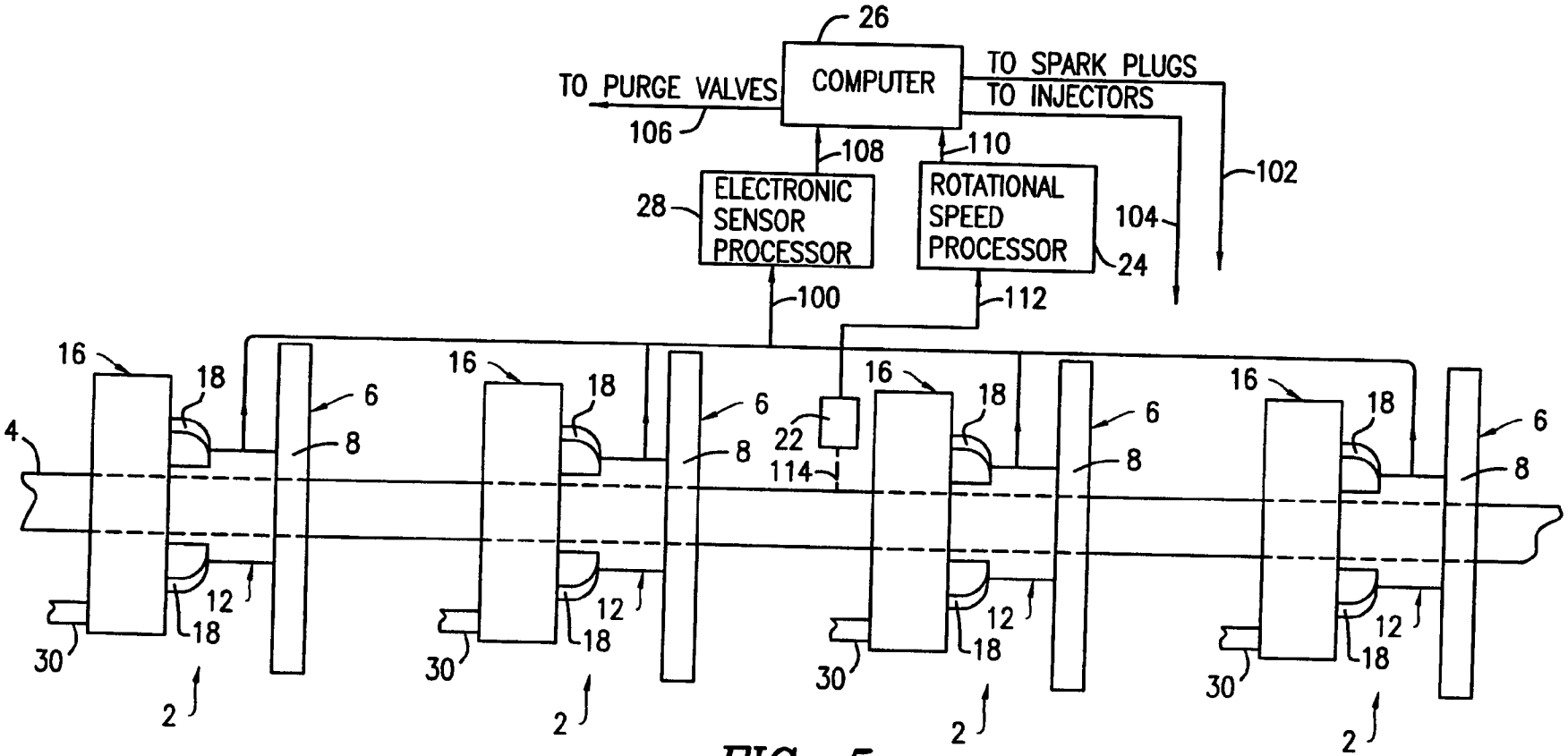
FIG. 5 shows a block schematic view of a plurality of individual rotary piston engines connected in series to rotationally drive a common drive shaft for another embodiment of the invention.

In FIG. 5, a plurality of the present rotary piston engines 2 are connected in series for rotationally driving a common drive shaft 4, in another embodiment of the invention. Each of the rotary engines 2 can be considered an engine module, and each share a common rotational speed/angle transducer 22 and processor 24, as shown. Although for the sake of simplicity, only single control cables or lines 102, 104, and 106 for spark ignition or spark plug 48 control, for injector 46 control, and for operating the purge valves 50, respectively, multiple cables or signal lines are required. Similarly, although a single signal line 100 is shown for connecting signals from the sensors of each one of the engines 2 to the electronic sensor processor 28, a plurality of sensor signal lines are required. The computer 26 is programmed as previously indicated for a single present rotary engine 2, to operate the spark plugs 48 and injectors 46 at appropriate times in accordance with power demands such as throttle signals brought to the computer on control line 116, in combination with the values of sensor signals, and the rotational speed of the drive shaft. As a result, the computer 26 may operate each one of the rotary engines 2 in identically the same manner for obtaining a desired power output and/or drive shaft speed, or alternatively may operate various ones of the ganged together rotary engines 2 in a different manner relative to each other for obtaining a desired power output and drive shaft speed. Also, computer 26 can be programmed to sense a malfunctioning rotary engine 2 module, and respond by terminating its operation, while continuing to maintain operation of the other rotary engine 2 modules.

Figure 6:
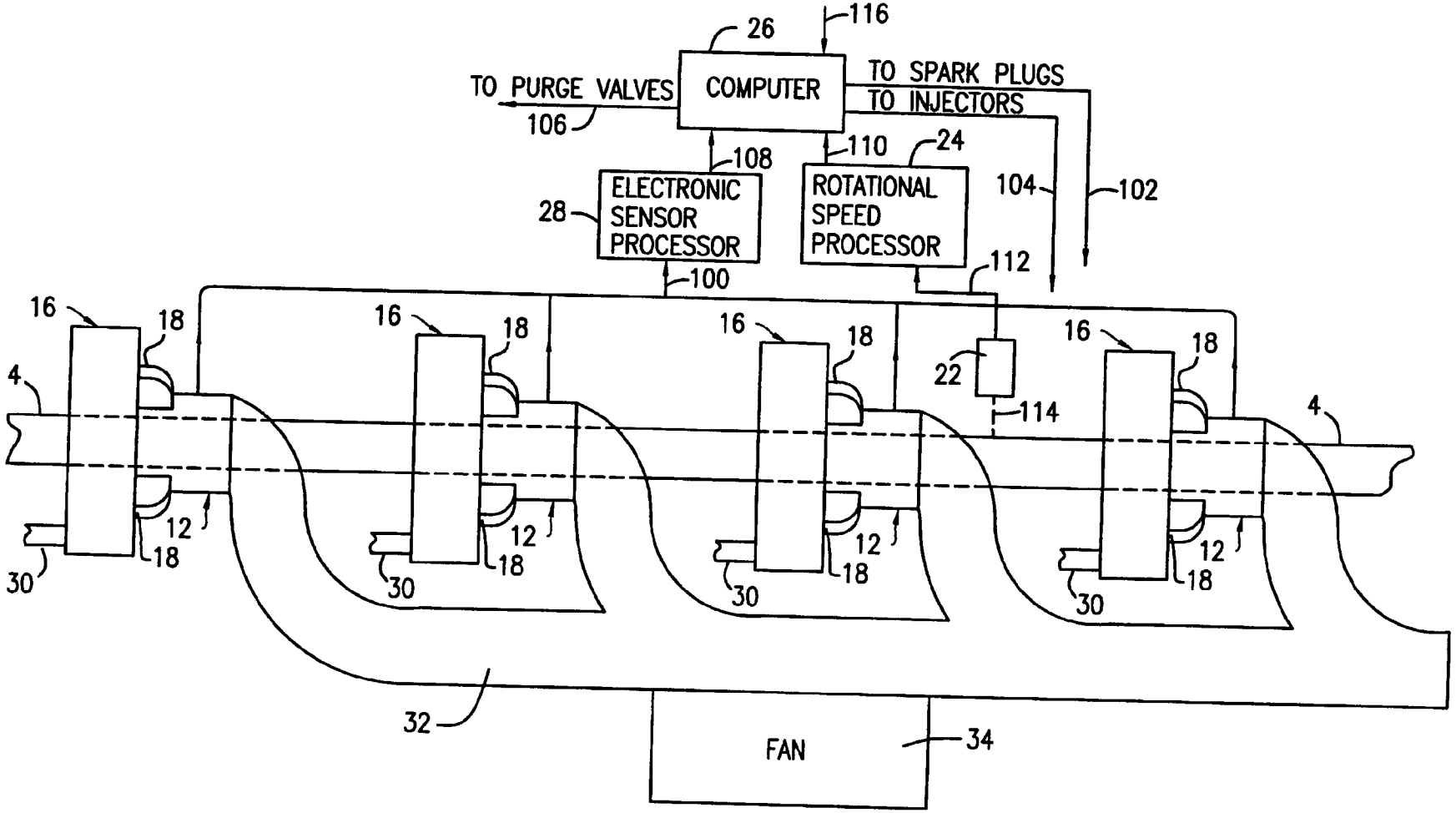
FIG. 6 is a block schematic diagram showing a plurality of modified rotary piston engines connected in series to drive a common drive shaft, whereby each of the rotary engines share a centrally located electrically or mechanically driven fan via a manifold arrangement, for yet another embodiment of the invention.

In the embodiment of FIG. 5 for connecting a plurality of the subject rotary engines 2 in series to drive a common drive shaft 4, note that each one of the rotary engines 2 includes its own fan or blower 6, and as such each can be considered an engine module. Alternatively, the rotary engines 2 can be modified in another embodiment of the invention for sharing a common fan 34 via a blower or air duct 32, as shown in FIG. 6. The fan 34 can be mechanically or electrically operated. Otherwise, relative to the operation of the configuration of FIG. 6, the operation is substantially the same as that mentioned for the embodiment of FIG. 5.

Figure 7A:
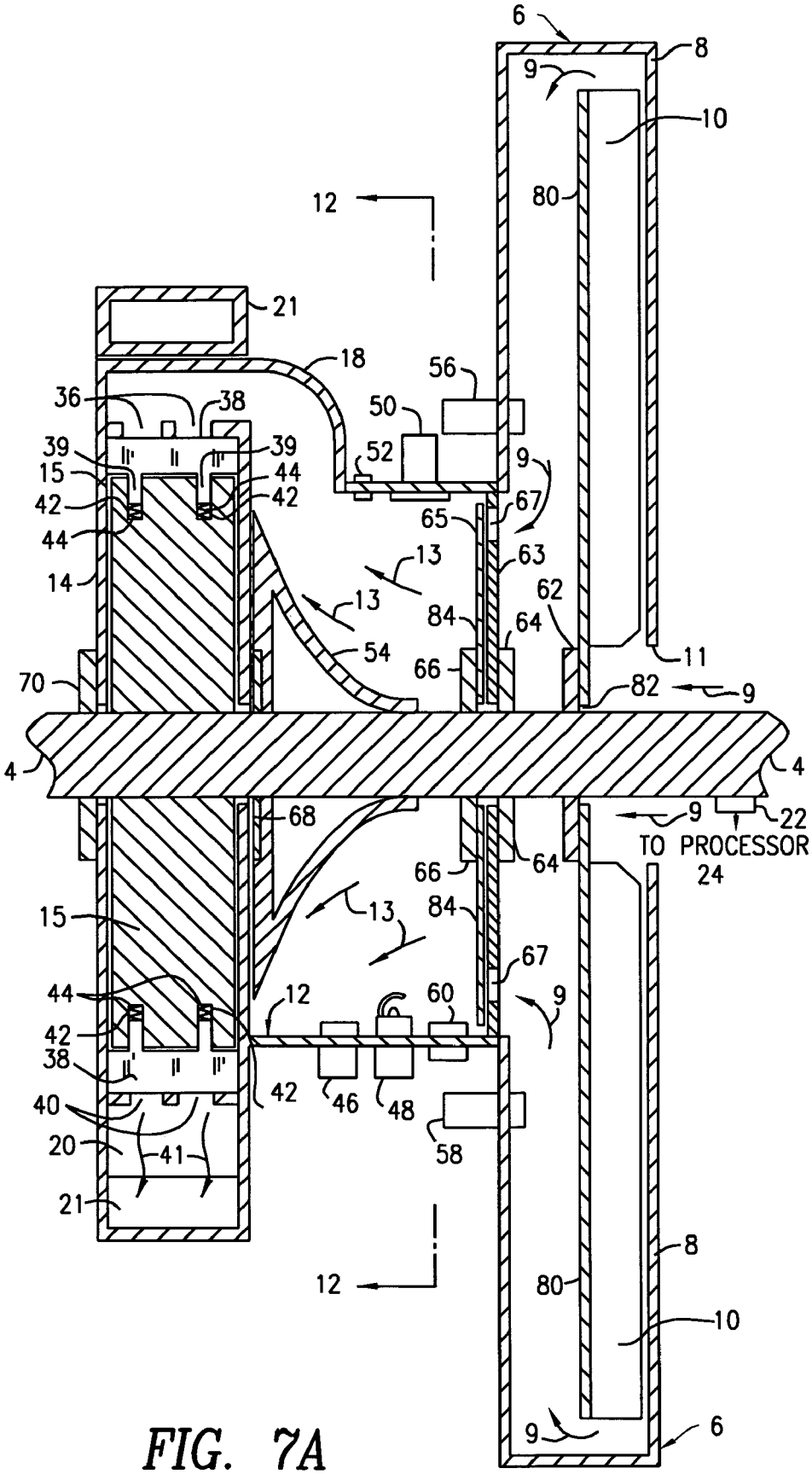
FIG. 7A is a longitudinal partial cutaway and partial cross section taken along 7—7 of FIG. 2, for one embodiment of the invention.
Figure 7B:
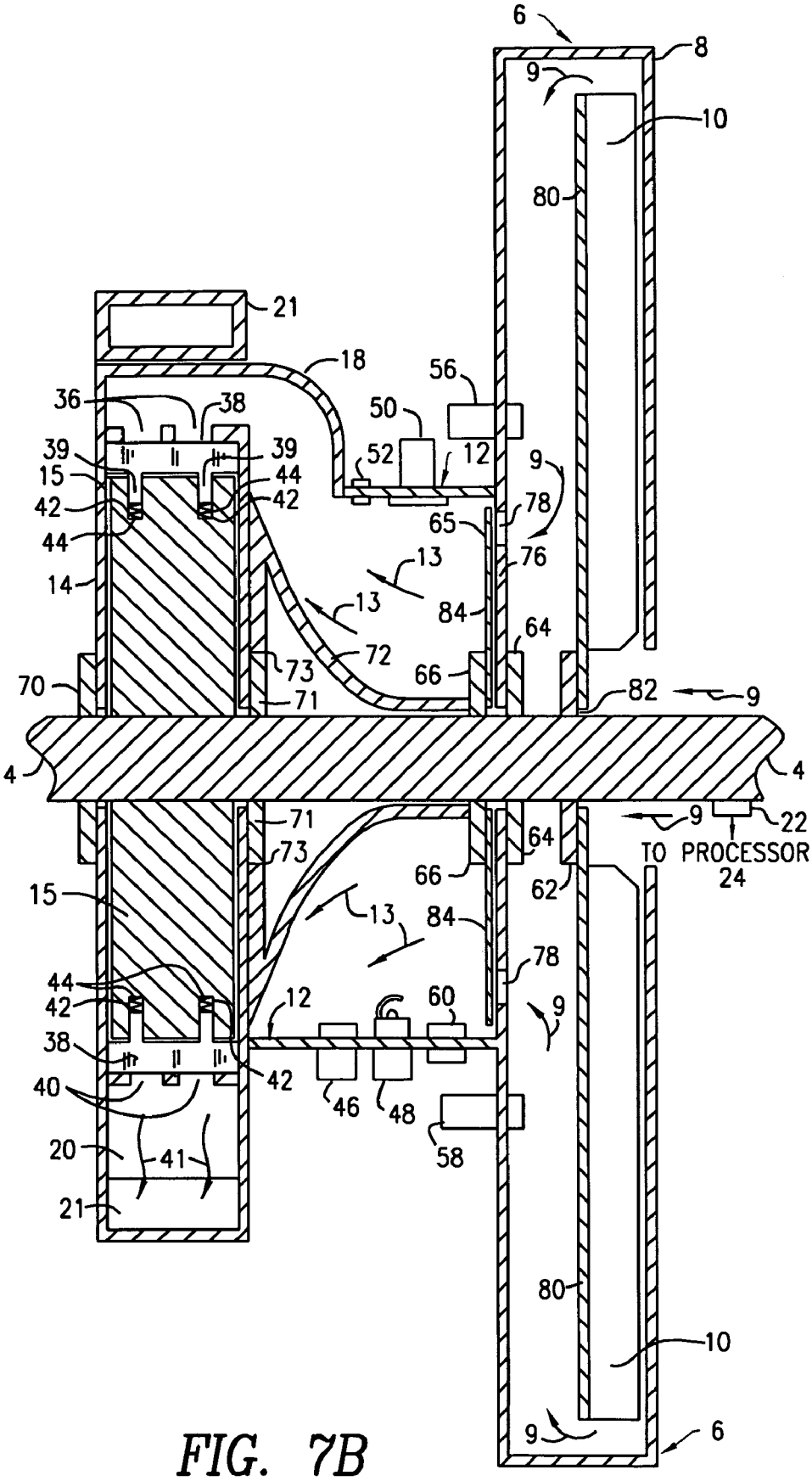
FIG. 7B is a longitudinal partial cutaway and partial cross section taken along 7—7 of FIG. 2, for another embodiment of the invention that is a modification of the embodiment for FIG. 7A.
Figure 7C:
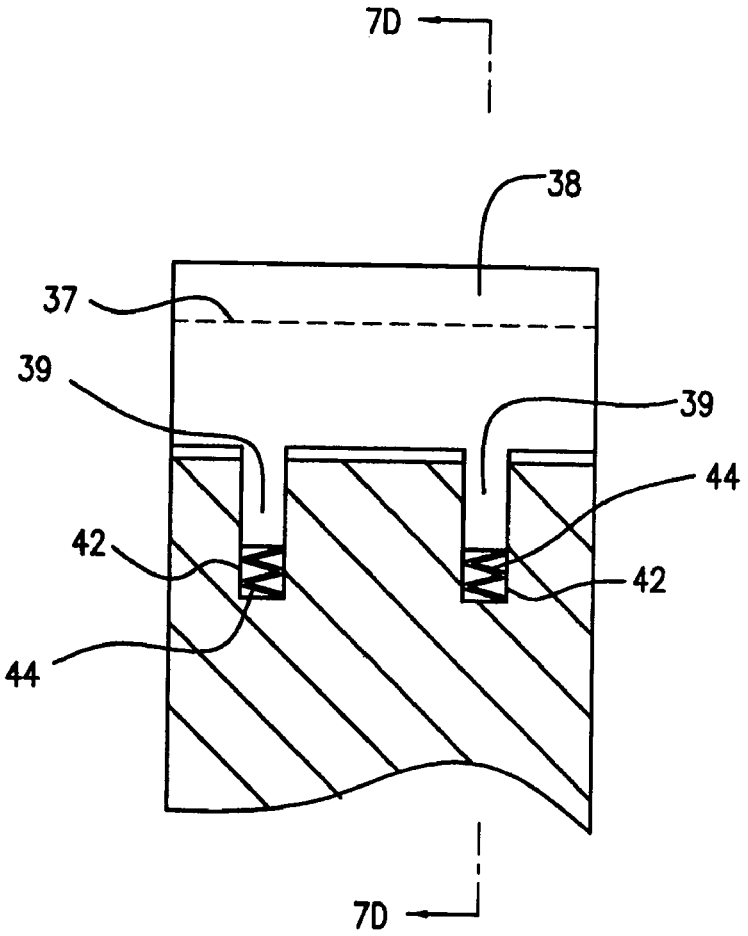
FIG. 7C is a detail cross section and partial cutaway view of the portions of FIGS. 7A and 7B including a vane, spring hole, spring, and piston section.
Figure 7D:
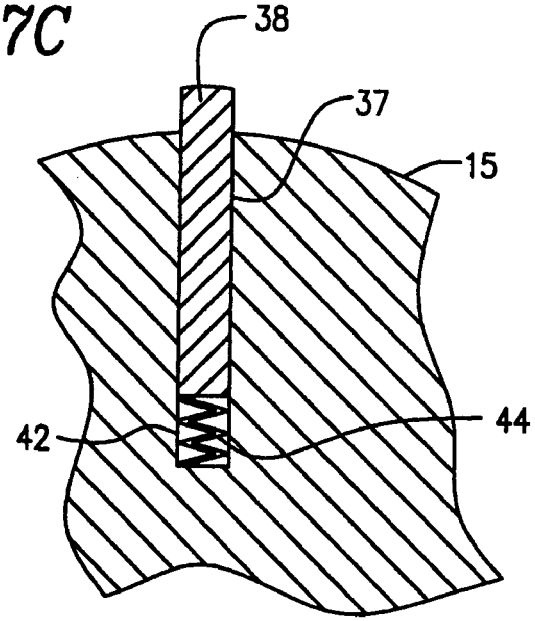
FIG. 7D is a cross section taken along 7D—7D of FIG. 7C.
Figure 8:
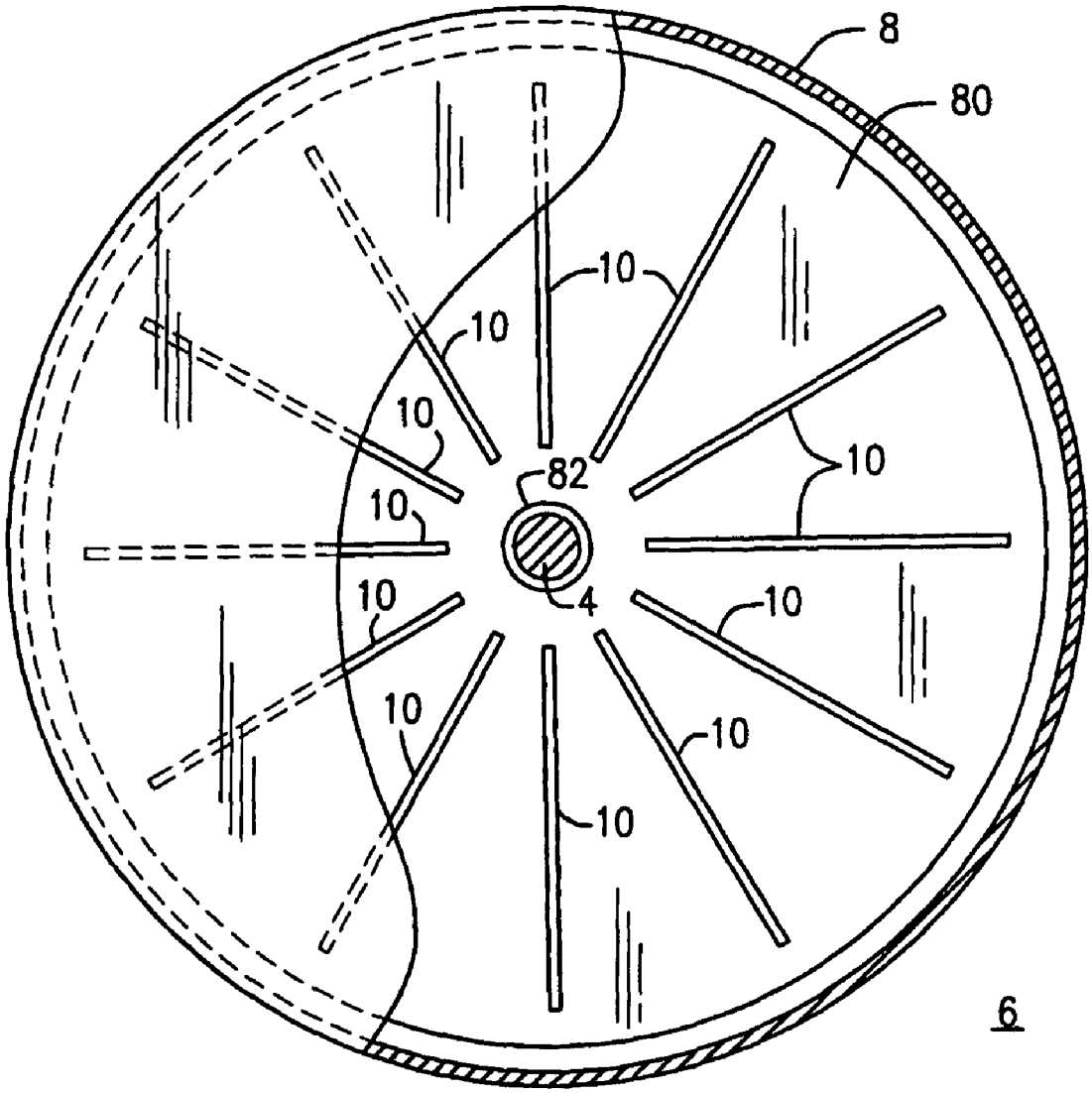
FIG. 8 is a partial cutaway end view of the fan or blower for one embodiment of the invention.

Reference will now be made to FIGS. 7A and 7B, showing alternative embodiments of the invention. Each shows a cross section of the rotary engine 2 taken along section lines 7—7 of FIG. 2.

Figure 9:
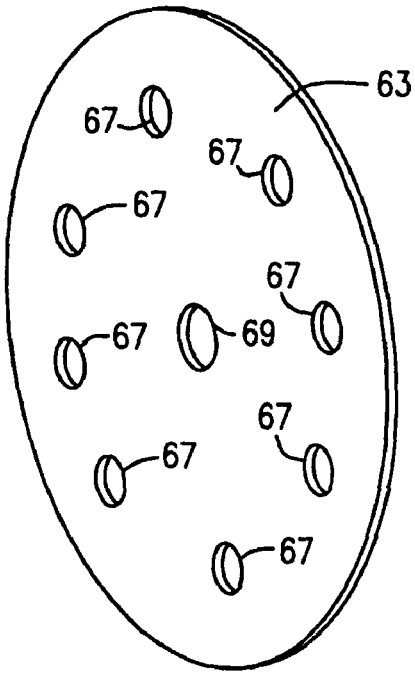
FIG. 9 is a perspective view looking toward the edge and front face of a valve plate for an embodiment of the invention.

In the embodiment of FIG. 7A, the fan or blower 6 includes the fan housing 8 substantially surrounding a plurality of impellers 10 or fan blades 10 that are each mounted upon an impeller disk 80, as shown. The center portion of the impeller disk 80 is secured to a seal ring 62 that is rigidly connected to drive shaft 4, whereby as drive shaft 4 rotates it will rotate impeller disk 80 in the associated impeller or fan blades 10. Note a central hole 82 in impeller disk 80 is greater in diameter than the outside diameter of drive shaft 4. Also, a hole 11 is provided in the center of fan housing 8 for entry of drive shaft 4 (also see FIG. 3). A valve plate 63 (also see FIG. 9) is rigidly connected, typically via welding (not shown) between the fan housing 8 and the combustion chamber 12, with the drive shaft 4 passing through but not touching the central hole 69 of valve plate 63, as shown. A seal bearing 64 is rigidly connected to the central portion of the valve plate 63 surrounding its hole 69, whereby the drive shaft 4 passes through the seal bearing 64 in a manner permitting rotation thereof, while preventing air leakage between the fan housing 8 and combustion chamber 12. Valve plate 63 also includes a plurality of through holes 67 spaced evenly apart in a circular configuration concentric with an interior portion of the valve plate 63.

Figure 10:
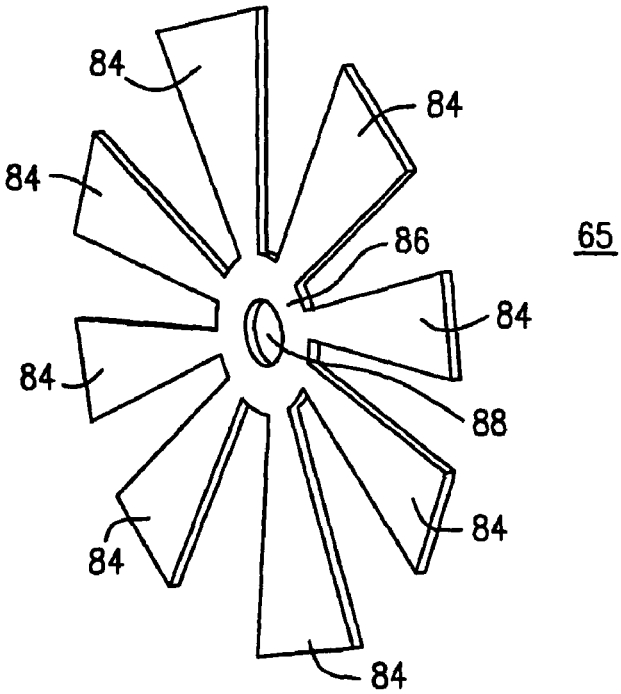
FIG. 10 is a perspective view of a shutter valve member including a plurality of shutter fingers, for an embodiment of the invention.
Figure 11A:
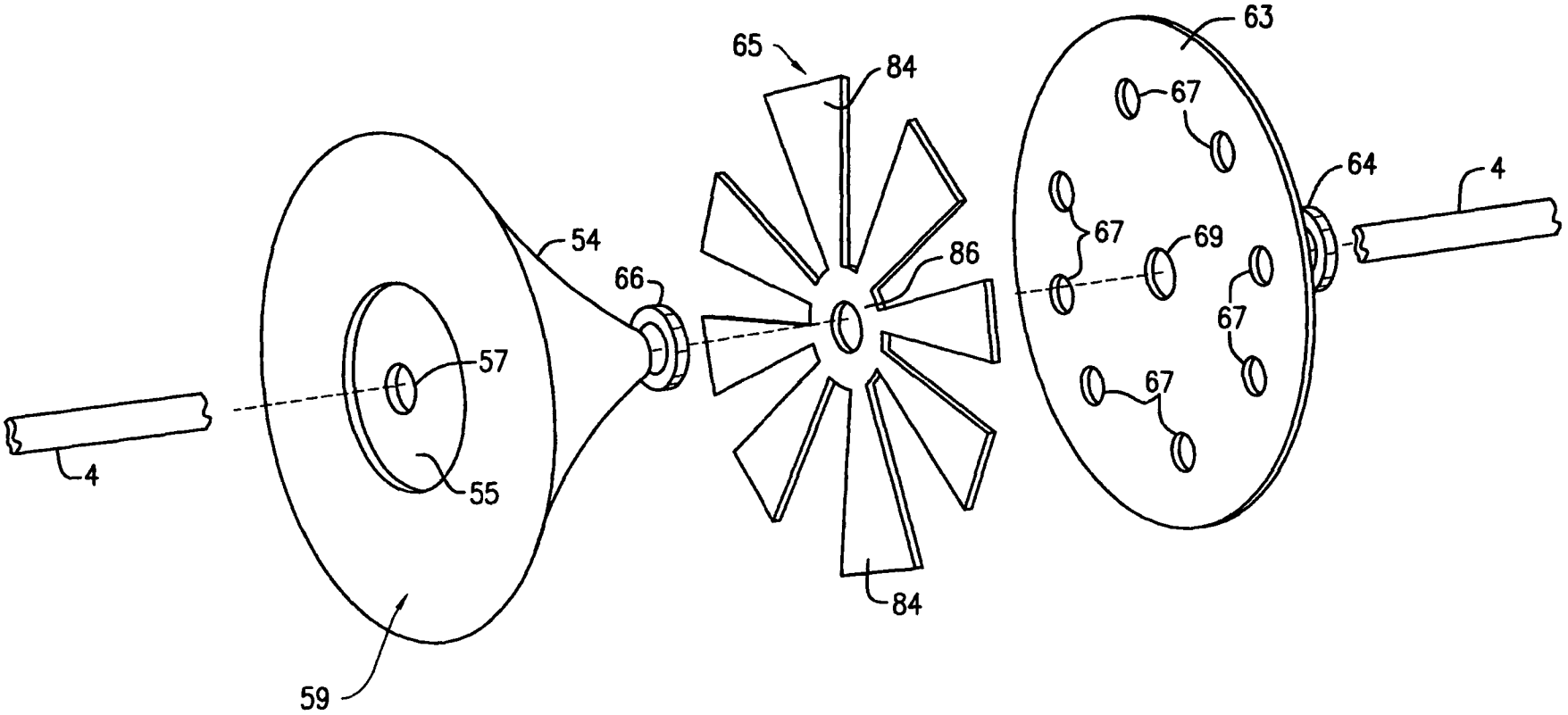
FIG. 11A is an exploded assembly view showing the positioning before assembly of a deflector shield, a shutter valve member, and a valve plate for one embodiment of the invention.
Figure 11B:
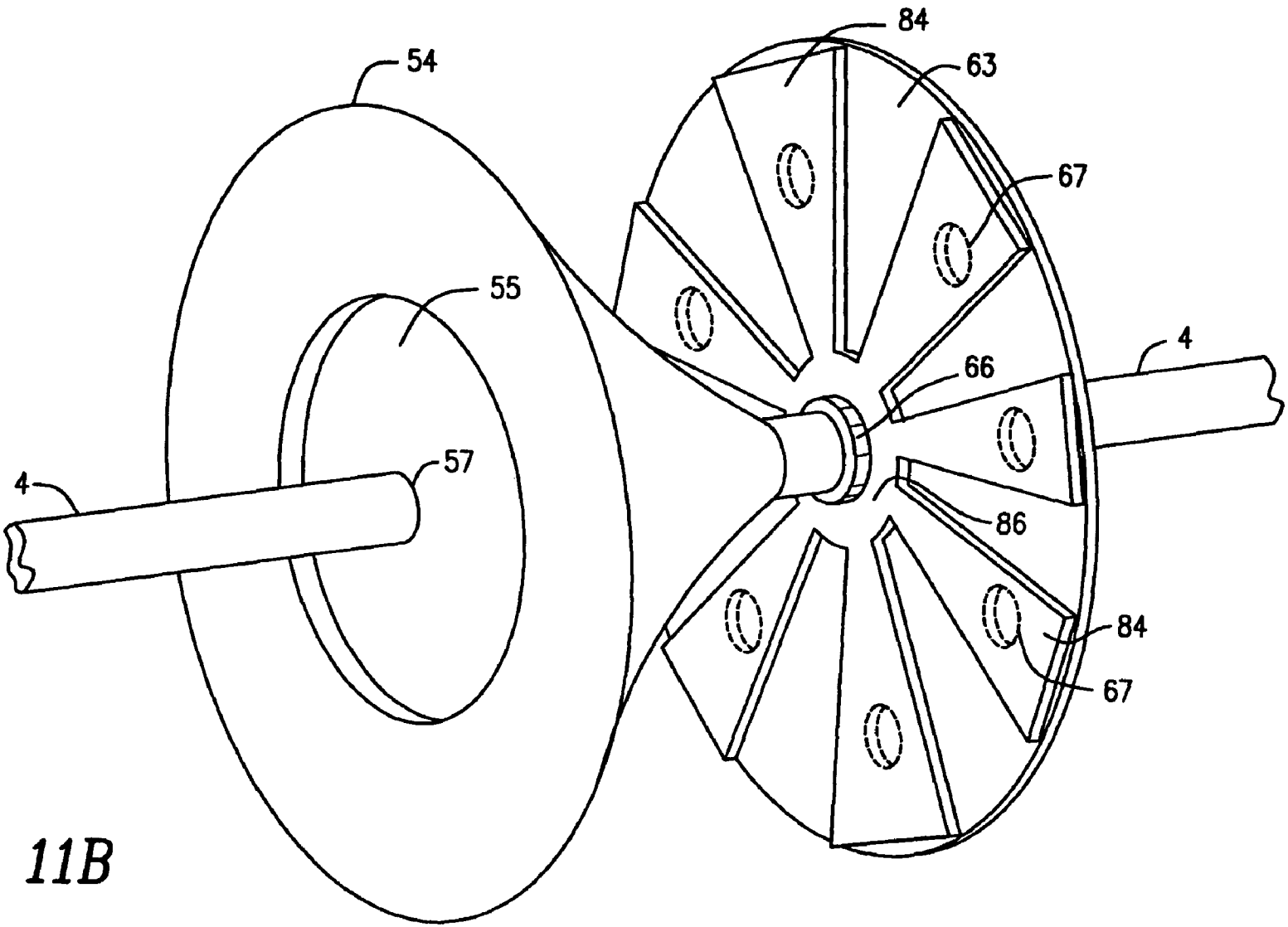
FIG. 11B shows the assembly of a deflector shield, shutter valve member, and valve plate for one embodiment of the invention.

A shutter disk 65 (also see FIGS. 10, 11A and 11B) is mounted within the combustion chamber 12 proximate the valve plate 63, as shown. The shutter disk 65 includes a plurality of shutter flaps 84 radially protruding from a shutter mounting ring 86, with the mounting ring 86 including a central through hole 88 of a large enough diameter to permit the drive shaft 4 to pass through unobstructed. The single piece shutter disk 65 has its mounting ring 86 rigidly secured to a seal bearing 66, as shown. The seal bearing 66 permits rotation of the drive shaft 4 passing therethrough, while further sealing the combustion chamber 12 from the fan housing 8. The plurality of shutter flaps 84 are each positioned to be proximate one of the through holes 67 of valve plate 63, whereby if a valve flap 84 is pushed against its associated through hole 67, air from fan housing 8 will be prevented from flowing through the through hole 67, and combustion gases will be prevented from flowing into the fan housing 8, as will be described in greater detail below.

In the embodiment of FIG. 7A, a guide shield 54 (also see FIGS. 11A and 11B) is substantially shaped as a truncated cone or a funnel with the drive shaft 4 passing through the central portion thereof, as shown. The portions of the reflector or guide shield 54 closest to the drive shaft 4 are welded or otherwise rigidly fixed to the drive shaft 4. The drive shield 54 includes a countersunk portion 55 surrounding a through hole 57, for permitting the associated broad face 59 thereof to be positioned close to but not touching the inside wall of the piston chamber 14, with the countersunk region or portion 55 partially enclosing but not touching a seal bearing 68. In this manner, the deflector or guide shield 54 is freely rotated by the drive shaft 4. The seal bearing 68 is mounted with the drive shaft 4 passing therethrough for rotation, while sealing off any air flow between the piston chamber 14 and the combustion chamber 12. Note the exploded assembly view of FIG. 11, and the completed assembly view of FIG. 11B, which clearly show the positional relationship between the guide shield 54, drive shaft 4, seal bearing 66, and valve plate 63.

Note that transducer 22 is shown in FIG. 7A in very close proximity to the drive shaft 4. It is likely that the speed transducer 22 will be mounted in a manner that it is very close to but not touching the drive shaft 4.

Figure 12:
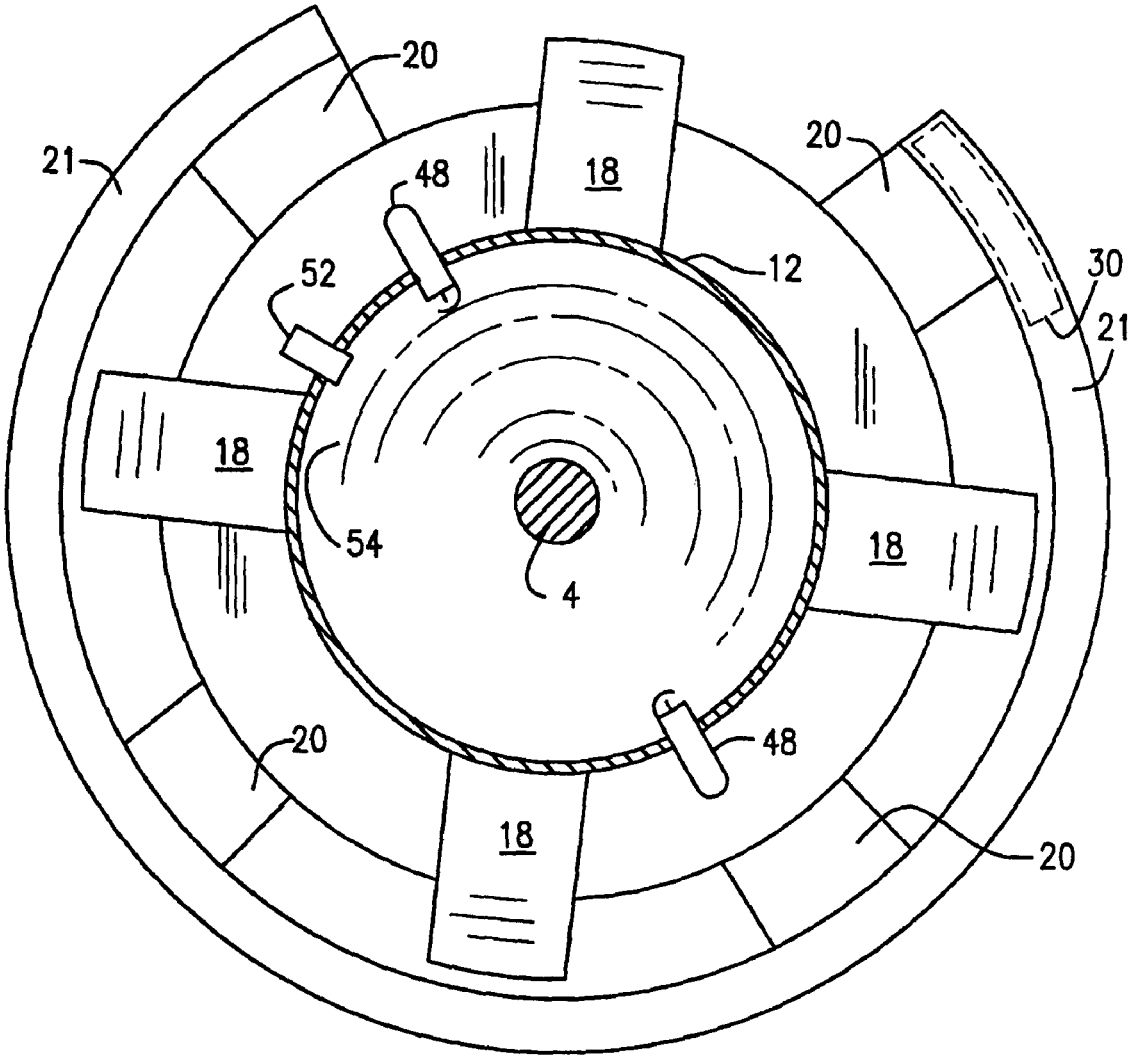
FIG. 12 is a cross sectional partial cutaway view taken along 12—12 of FIG. 7A, showing a portion of the combustion chamber for one embodiment of the invention.
Figure 13:
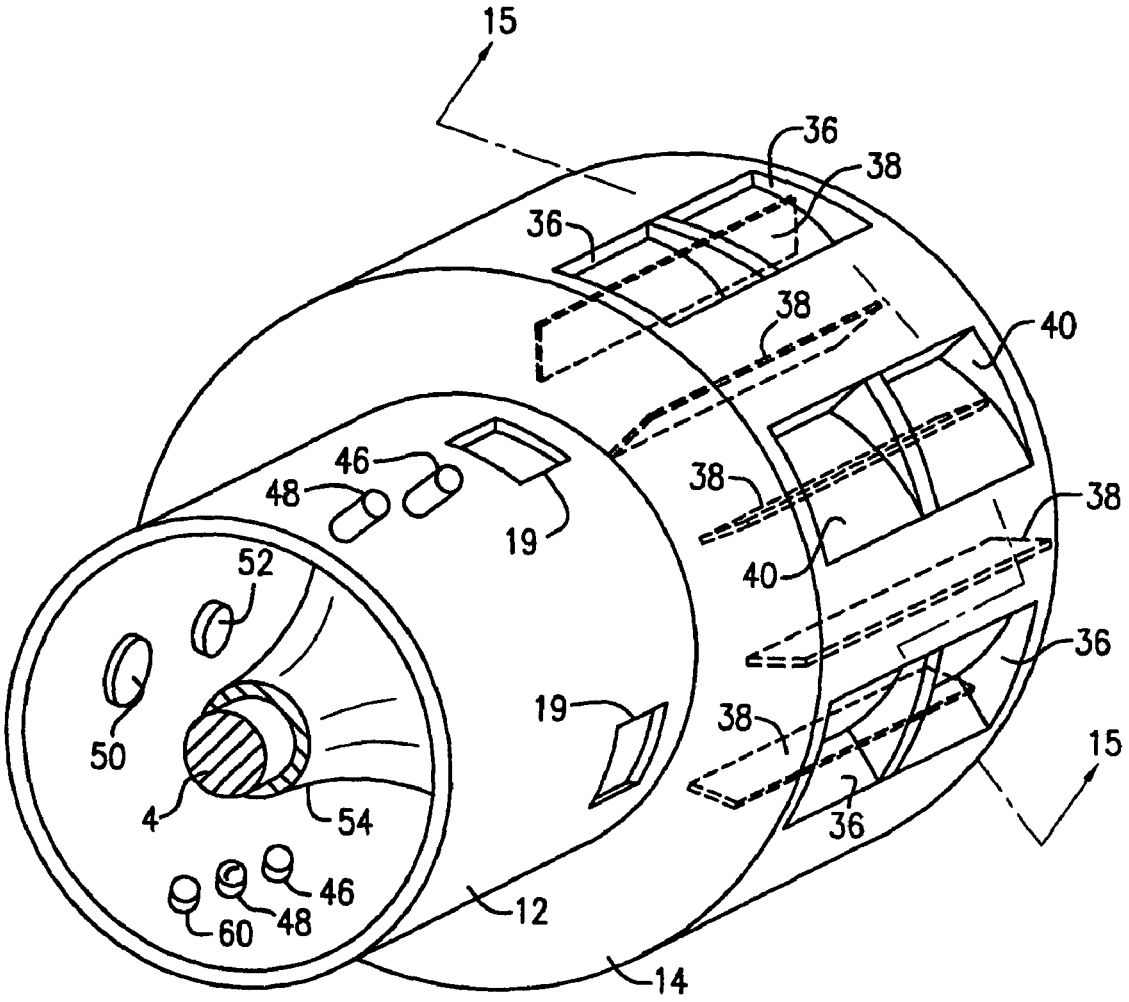
FIG. 13 is a partial perspective view of the assembly of the combustion chamber and piston chamber or housing with the manifold assembly and fan or blower housing removed, for one embodiment of the invention.
Figure 14:
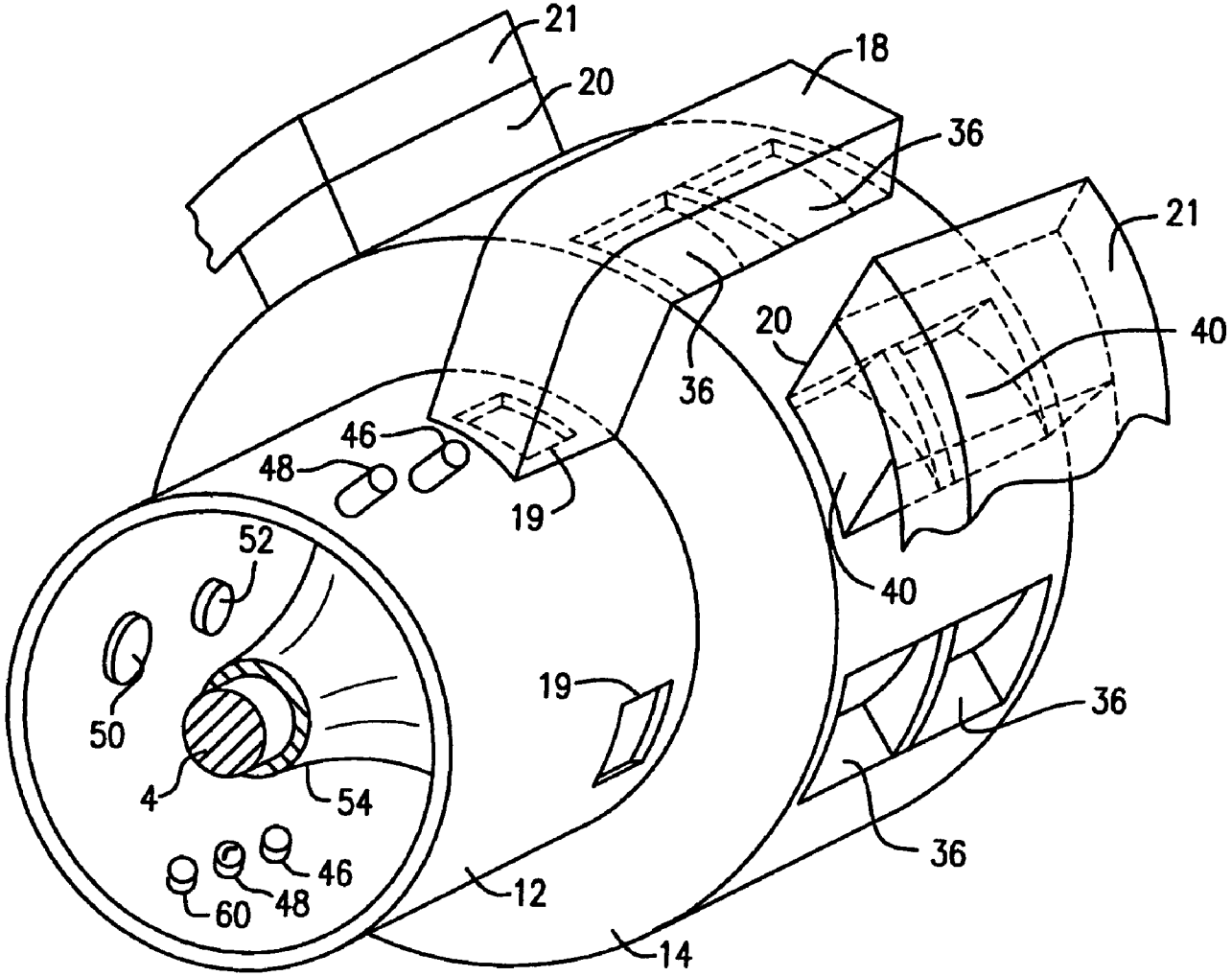
FIG. 14 is a partial perspective view of the combustion chamber and piston chamber of FIG. 13 with the addition of a portion of the manifold assembly.

A fan or blower pressure sensor 56, and a input air temperature sensor 58 are mounted on the fan housing 8 for sensing the air pressure, and temperature of the air, respectively, of the air contained therein. Mounted through wall portions of the combustion chamber 12 are pressure sensor 52, and purge valve 50, injectors 46, spark plugs 48, and a combustion chamber temperature sensor 60. Reference is also made to FIGS. 12, 13, and 14 for positioning of spark plugs 48, injectors 46, purge valve 50, pressure sensor 52, and temperature sensor 60.

With further reference to FIG. 7B, alternative embodiments of the invention are shown relative to FIG. 7A. More specifically, in one of these embodiments the valve plate 63 has been eliminated, and in its stead air intake holes 78 have been drilled through an interior portion of the fan chamber valve wall 76 in a pattern identical to the pattern of the holes 67 of valve plate 63. The finish applied to the fan chamber valve wall 76 portions proximate the shutter flaps 84 of shutter disk 65, respectively, must be smooth enough to provide a good seal between associated ones of the holes 78 and shutter flaps 84. Also in another embodiment as shown, the guide shield design is modified to provide a non-rotatable guide shield 72, as shown. More particularly, the narrow portion of the guide shield 72 is of large enough diameter to permit the drive shaft 4 to pass through unobstructed, as shown. The ends of the narrow portions of the guide shield 72 are rigidly attached via welding or through other suitable means to the seal bearing 66, as shown. Also, a central hole 73 in the broad face of the guide shield 72 is rigidly attached to the seal ring 71, as shown. The seal ring 71 has been substituted for the seal bearing 68 of the embodiment of FIG. 7A, and allows drive shaft 4 to rotate while preventing gases from flowing between combustion chamber 12 and piston chamber 14. As a result, the guide shield 72 will remain stationary as the drive shaft 4 rotates.

With further reference to FIGS. 7A, 7B, and 12 through 15, further embodiments of the invention will be described. The combustion chamber 12 has first portions thereof connected via intake manifolds 18 to respective input ports 36 of piston chamber 14, as shown, for passing high pressure combustion gases in piston chamber 14. As previously mentioned, the intake manifolds 18 are formed within the manifold assembly 16, which can be a one piece casting or fabricated in pieces that are secured together. A substantially cylindrical piston 15 is rotatably secured to the drive shaft 4, as shown. Also shown in the cross section of the piston chamber 14 of FIGS. 7A and 7B are exhaust ports 40 for passing exhaust gas 41 into the exhaust manifold ring 21.

With further reference to FIGS. 7A, 7B, 7C, 7D, 13, and 15, details of the mechanical configuration for operating the vanes or rotor blades 38 will now be described. The width of the vanes 38 is made sufficient to always provide for a top free edge of each vane 38 to maintain contact with the inside wall 17 of piston chamber 14 (see FIG. 15) regardless of the angular position of piston 15. As shown, each vane 38 reciprocates between an extreme extended position away from an associated slot 37 and a position where a vane 38 is almost fully retracted into its associated slot 37 with only a small portion protruding and touching the inside wall 17 of the piston chamber, as previously mentioned. Note that at all times at least a portion of the vanes 38 remain within their respective slots 37. Each vane 38 includes a pair of spaced apart spring guide arms 39 that are at all times at least partially contained within an associated hole radially directed into the bottom of an associated slot 37. A spring 44 is located in the bottom of each one of the spring holes 42, with one end of each spring 44 touching the bottom of its associated spring hole 42. The other ends of the springs 44 are abutted against the bottom of their associated spring guide arms 39, as shown. In this manner, as the piston 15 rotates, the convoluted configuration of the inside wall portion 17 of piston chamber 14 provides a cam track causing the vanes 38 to reciprocate between their two extreme positions, as can be seen from FIG. 15. The springs 44 provide sufficient force against the spring guide arms 39 for ensuring that the top edges of the vanes 38 are sufficiently sealed against the inside wall 17, while providing a coefficient of friction therebetween permitting relatively easy rotation of the piston 15. As shown, a vane 38 is in a maximum retracted position proceeding half the distance clockwise from an exhaust port 40 to an input port 36, and in a maximum extended position proceeding clockwise half the distance between an input port 36 to an exhaust port 40.

Figure 16:
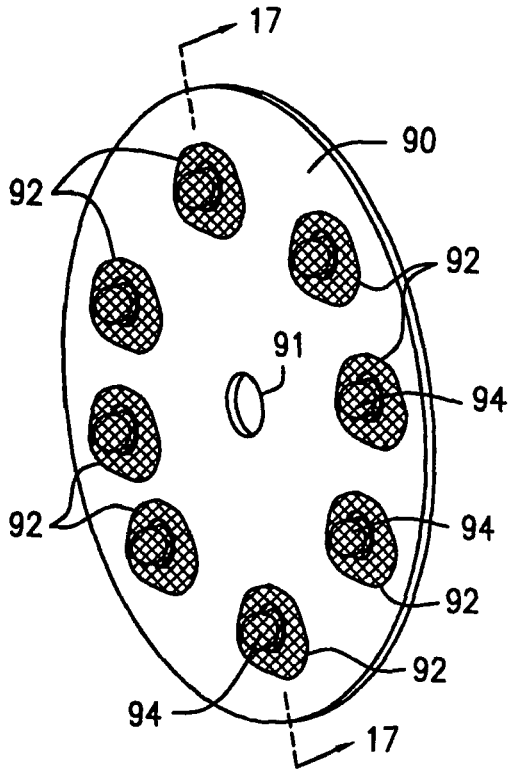
FIG. 16 is a perspective view looking toward the front face of a valve plate with cage ball and seat valves for an alternative embodiment of the invention.
Figure 17:
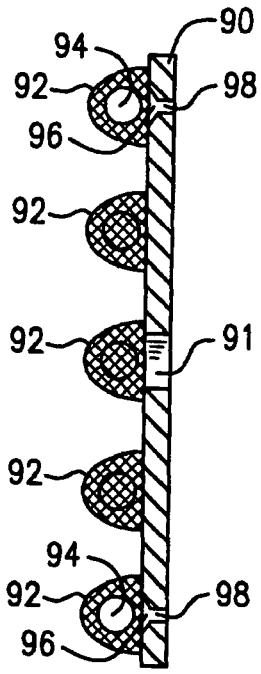
FIG. 17 is a cross sectional view taken along 17—17 of FIG. 16 of the cage ball and seat valve assembly.

In FIGS. 16 and 17, an alternative embodiment of the invention is shown relative to the embodiment of FIG. 7A. More specifically, the valve plate 63 and shutter disk 65 are replaced by a cage valve plate 90, having a centrally located hole 91 through which the smaller diameter drive shaft 4 freely passes. Assembled onto and integral with the cage valve plate 90 are a plurality of valve balls 94 retained within respective mesh cages 92, for sealing against opposing valve seats 96 of respective air intake holes 98, as will be described. The cage valve plate 90 is mounted between the fan housing 8 and combustion chamber 12 as previously described for the valve plate 63. Note further for this alternative embodiment that the seal bearing 66 can either be eliminated, or can be retained and rigidly secured to the opposing portion of the cage valve plate 90. In operation of this embodiment, whenever a fuel/air mixture is ignited within combustion chamber 12, the resulting combustion product pressure will force the balls 94 that protrude into the combustion chamber to move into their respective valve seats 96, closing off their respective air intake holes 98. At times that the pressure within the combustion chamber 12 is less than the pressure created by the fan 6, the balls 94 move away from their respective valve seats 96, permitting air to flow from the fan 6 through the air intake holes 98 into the combustion chamber 12. In operation of the embodiment of the invention including the shutter disk 65, the shutter flaps 84 reside in a rest position away from air intake holes 67, as shown in FIGS. 7A, and 7B, whenever the air pressure in fan housing 8 is greater than the pressure in combustion chamber 12, air from fan housing 8 passes through the air intake holes 67 into combustion chamber 12. Similar to the alternative embodiment, upon combustion in the combustion chamber 12, the combustion gas pressure forces the shutter flaps 84 to bend toward and seal off the air intake holes 67 for the period of time that the air pressure within the combustion chamber 12 exceeds the air pressure in the fan housing 8. These processes will be described in greater detail below relative to the overall operation of the present rotary piston engine.

The basic operation of the present rotary engine will now be described with reference to all of the drawings, and particularly with reference to FIGS. 1, 7A, 13, and 15. Assume that the present rotary piston engine 2 is inoperative. Further assume that at this time sufficient air has entered into combustion chamber 12 for mixing with injected fuel to provide a combustible mixture. To start the engine 2, at least one of the fuel injectors 46 is operated to inject fuel (assume that the fuel is gasoline under pressure from a fuel pump, not shown). The injected fuel is typically injected in the form of very small particles for mixture with the air. At the appropriate time thereafter a spark plug 48, preferably the spark plug 48 closest to the activated fuel injector 46, is operated to produce a spark for igniting the fuel/air mixture. The combustion gases 13 cause the pressure within the combustion chamber 12 to be greater than the air pressure within the fan housing 8, forcing the shutter flaps 84 to move against and seal off their associated air intake holes 67 in valve plate 63, as previously discussed. This prevents air 9 from passing from the fan 6 into the combustion chamber 12 during the combustion cycle, and causes the combustion gases 13 to pass from combustion chamber 12 through intake manifolds 18 and associated input ports 36 of piston chamber 14, into the piston chamber 14. Particularly with reference to FIG. 15, the combustion gases then push against the vanes 38 proximate the associated input ports 36 on the portions of the associated vanes 38 exposed to an associated input port 36, particularly the vanes 38 in their relatively greater extended positions between intake input ports 36 and exhaust ports 40, respectively. As the piston 15 rotates, the portions of the ones of the vanes 38 or faces thereof that were initially exposed only to the combustion gases from associated input port 36 begin retracting and move toward an exhaust port 40, permitting the now spent combustion gases to pass through the exhaust port 40 into the exhaust manifold ring 21. In this example, note that the rotor 15 must rotate in a clockwise direction. However, by merely reversing the input ports 36 and exhaust ports 40, the piston 15 would then rotate in a counter clockwise direction.

The convoluted cam surface provided by the inside wall 17 of piston chamber 14 causes the vanes 38 to reciprocate as previously described, and also ensures that the combustion gases impart maximum force against the vanes 38 for rotating the piston in a desired clockwise or counter clockwise direction, the example presently being presented for clockwise rotation, as indicated. Note that the length of each one of the vanes 38 is greater than the combined lengths of the pairs of input ports 36 and exhaust ports 40 (see FIG. 13). The length of the vanes 38 are substantially equal to the length of the cylindrical piston 15, in this example and both the side portions of the piston 15 and sides of the vanes 38 are dimensioned to be as close as possible to the opposing inside walls of the piston chamber 14 without touching the same. As previously indicated, the operation of the rotary engine 2 is controlled by the computer 26. A more detailed explanation of the operation will now be described.

Figure 15:
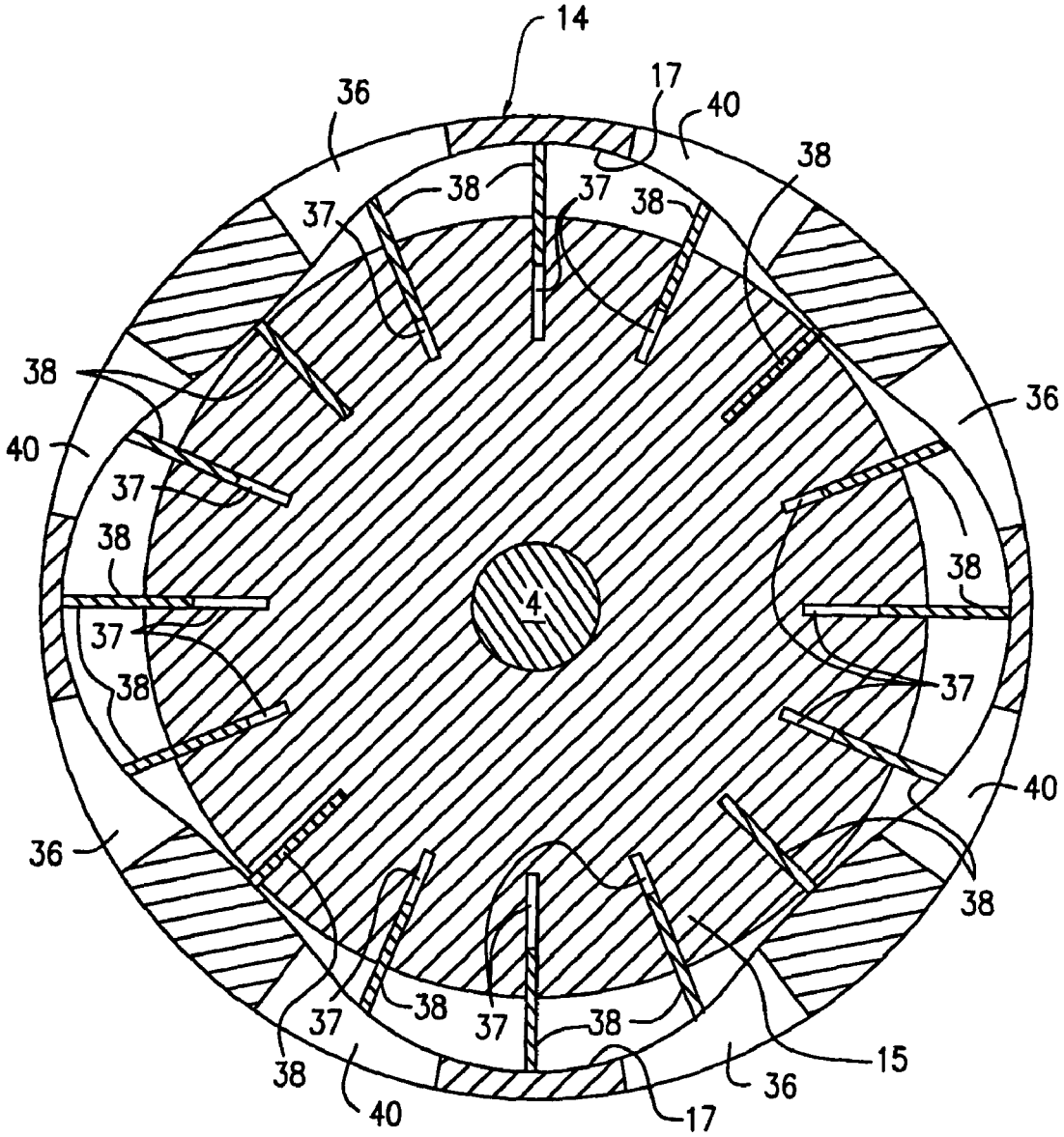
FIG. 15 is a cross sectional view taken along 15—15 of FIG. 13 of the assembly of the piston chamber or housing with a rotary piston, for an embodiment of the invention.

Assume that a present rotary piston engine 2 is installed to provide the drive source for a vehicle that includes an electric or electronic throttle, for example. When a driver, in this example, turns on the ignition of the vehicle, power is applied to the computer 26, the electric throttle, and other electrical and electronic devices associated with engine 2. In this example, to start the engine, the electric throttle is at least slightly depressed for causing an electrical signal to be applied to computer 26, in turn causing the computer to operate at least one of the fuel injectors 46 for injecting an appropriate amount of fuel into combustion chamber 12 for mixing with air therein. The engine is then started as previously described by igniting at least one of the spark plugs 48. The combustion cycles are repeated as appropriate for providing the required speed of rotation of drive shaft 4 and power output. For proper operation, in view of the engine 2 operating in a manner that simultaneously provides a power cycle and an exhaust cycle, signals must be developed and sent to computer 26 for indicating the completion of a given power stroke, analogous to completion of a combustion cycle. To accomplish such signaling, speed sensor transducer 22, as previously described, provides signals to computer 26 via processor 24 for indicating the degree of rotation or distance of travel of the piston 15 relative to datum marks 5, over a given measuring period as described above, in this example. As previously described, each datum point or mark 5 is placed on the drive shaft 4 for detection by sensor 22, whereby each datum mark 5 can also be in axial alignment with a datum point on the piston 15 relative to the piston 15 being positioned as shown in FIG. 15, whereby computer 26 can be programmed to use the signaling of the passing of a datum mark 5 coupled with the detected drive shaft speed analogous to the rotational speed of the piston 15 to compute the angular position of the piston 15 relative to the datum points, analogous to distance traveled, for in turn providing information relative to the termination of combustion or power cycles for initiating when required a new combustion or power cycle. In the preferred embodiment, computer 26 is programmed to initiate successive combustion cycles over a period of time dependent upon power and speed requirements during the time period. Also the rotational information permits computer 26 to be programmed to anticipate when the shutter flaps 84 return to their rest position after a combustion cycle, as a result of the pressure in the combustion chamber 12 reducing to below the pressure within the fan housing 8, for permitting a new supply of fresh air to pass through air intake holes 67 in valve plate 63, for example, in one embodiment, for permitting another combustion cycle to be initiated. As previously indicated, pressure sensors 52 and 56 provide signals to the computer 26 indicative of the pressure in the combustion chamber 12 and fan housing 8, respectively, at any given time. In this manner, computer 26 is provided with data indicative of the time that the pressure has decreased to a point where air can be pushed into combustion chamber 12 from fan 6 for the next combustion cycle. Note that connections from the various sensors to the computer are not necessarily indicated by a signal line from a given sensor drawn to the computer 26, whereby some of these signal lines are generally shown by a signal line 100 for purposes of simplicity of the drawings, as shown in FIG. 1.

Providing signals to computer 26 indicative of the differential in pressure between the pressure within combustion chamber 12, and that within fan housing 8 is important to proper operation of the engine 2, because as the speed of the drive shaft 4 (RPM or revolutions per minute) increases, the pressure of the air 9 developed within the fan housing 8 by rotation of the impeller or fan blades 10 increases, thereby causing the shutter flaps 84 to open the air intake holes 67 at different differentials in pressure between combustion chamber 12 and the interior of fan housing 8. Accordingly, the time between combustion cycles can be decreased as the drive shaft 4 speed increases, whereby the number of combustion cycles available over a given period of time are directly proportional to the speed of the drive shaft 4 over that period of time. For very high speed operation, or high torque operation, a purge valve 50 can be provided as shown, that is operated by computer 26 for releasing pressure from the combustion chamber 12 in a manner permitting the number of combustion cycles to be increased for a given time period during such high speed operation or high torque operation. Also, additional fuel injectors 46 can be installed in the fan housing 8 near the air intake holes 67 of valve plate 63 for enhancing the fuel/air mixture to be combusted in the combustion chamber 12. Also, for better control, an input air temperature sensor 58 is installed in fan housing 8, and a combustion chamber temperature sensor 60 is installed in the combustion chamber 12, for providing temperature signals to computer 26. In summary, depending upon the throttle signals received by the computer, the computer could operate engine 2 at higher speed for greater depression of the throttle (not shown), and at lower speeds for less depression of the throttle. Note that the electric throttle can be provided by a number of known devices, such a laser operated devices, electro optical throttles, potentiometer or variable resistor type throttles, and so forth, for developing an electrical signal that can be utilized by computer 26.

The programming of the computer 26 can in one example be partly provided through the use of look-up tables, as would be known to one of skill in the art. For example, upon receiving a signal indicative of a given throttle setting, computer 26 can be programmed to enter an appropriate look-up table based upon a given throttle setting, pressure readings, temperature readings, drive shaft 4 speed, and other signals that it is receiving at a given time, for determining appropriate operation of the spark plugs 48, and injectors 46 at that time. The look-up tables for operating engine 2 for a particular application can be developed empirically through operation of engine 2 over all desired ranges for that application.

As would be known to one of skill in the art, the amount of pressure developed in the combustion chamber 12 is dependent upon the quantity of fuel injected into the combustion chamber and mixed with air prior to combustion. Computer 26 determines the amount of fuel to be injected from an injector 46 at any given time by use of the look-up tables relative to detected throttle settings, and sensor readings, as previously indicated. The data received from the look-up table provides the computer 26 with the length of time that one or more of the fuel injectors 46 should be activated, the time delay between fuel injection and detonation of the fuel/air mixture via one or more of the spark plugs 48 (timing delay), and the frequency of combustion cycles, that is the time period from one combustion cycle to another. As indicated, different settings of the throttle will cause computer 26 to obtain data from different sections of the look-up tables. For example, a certain application throttle settings from zero throttle to full throttle might be divided into twenty increments, whereby each increment may be equally spaced or unequally spaced, depending upon the application. Based upon empirically derived information for establishing the look-up tables, each throttle increment will be analogous to a different pressure/time value (the amount of pressure that must be developed in a given period of time subsequent to each ignition of fuel/air in combustion chamber 12). For example, a first increment might demand 50 pounds per square inch every five seconds, a second increment 75 pounds per square inch every five seconds, a third increment 100 pounds per square inch every five seconds, a fourth increment 125 pounds per square inch every five seconds, and so forth, as a throttle is depressed through the four increments, in this example. For an increasing throttle setting, the timing between combustion cycles may or may not change, but as the throttle is depressed to a greater degree, the computer 26 must ensure that the pressure created in the combustion chamber 12 increases in accordance with the throttle demands, or decreases with decreasing throttle.

In certain applications, the engine 2 may be operated at a constant speed, that is the drive shaft 4 may be maintained at a desired RPM level. The computer 26 must be programmed to meet the requirements of such an application, and any other application in which the rotary engine 2 can be utilized. For example, for an application regarding engine 2 to drive a given load at 100 RPM, a look-up table developed for that application may indicate that a fuel injector 46 must be activated for one second, followed by a 1½ millisecond lapse time before an appropriate one of the spark plugs 48 is energized to ignite the fuel/air mixture in combustion chamber 12. Other speed requirements, perhaps associated with throttle increments, for example, would likely provide different settings from the associated look-up table, such as a longer or shorter activation of one or more of the fuel injectors 46, and the same or different lapse times between fuel injection and ignition of the fuel/air mixture.

As indicated the look-up tables in a preferred embodiment of the invention are developed empirically. A less preferred method to develop the look-up tables is through computer simulation. Such computer simulated look-up tables might later be refined empirically.

To empirically develop the look-up tables, one would determine the power output requirements and application, and then build a prototype engine 2 that can meet the desired performance requirements. A prototype engine 2, as one of skill in the art would know, will then be operated over the entire desired range of operation, such as for different increments of a throttle, and varying load conditions. For each throttle increment or setting, the engine operation would be optimized relative to combustion cycles, emission timing, fuel injector timing, purge valve 50 operation, and so forth. A preferred operation for each throttle setting would then be recorded in the developing look-up table for programming computer 26. The operating parameters for each throttle setting recorded in the look-up table can be thought of as a template for that throttle setting, and as the default operational data for the computer 26. The look-up table can be considered to be the default for each particular throttle setting or increment, whereby the computer will automatically in the absence of other programming go to the look-up table any time that the throttle setting is changed in this example. For each throttle setting, the computer will obtain the appropriate template of operating parameters for ensuring desired operation of engine 2.

In developing a given look-up table, in one example two sets of templates can be utilized. The first set of templates are created by developing each template thereof to correspond to a given throttle setting, and first establishing optimum operation of the engine 2 under no-load conditions, as previously indicated above, and the operating parameters will then represent a no-load template. A set of such no-load templates will be incorporated in a look-up table for each throttle setting. Next, different loads will be placed upon the engine 2, engine 2 operation optimized for each load and analogous throttle setting, and the signals derived from the aforesaid sensors at each optimized engine operation are utilized to provide sensor signal for reaction templates. For any given throttle, one mode of operation, the computer 26 first uses the no-load template, and then based upon the sensed signals determines from the look-up table which sensor template is applicable for a given load upon the engine, and utilizes the sensor or return template for adjusting the engine operating parameters to satisfy the particular throttle setting and load conditions. Establishing these operating parameters utilizing the dual look-up table templates, as indicated, occurs so quickly that a driver of a vehicle, for example, would likely be unaware of the operating parameter changes being instituted by computer 26 as the driver changes throttle settings. Other templates for the look-up table can be established by operating the engine 2 at each given throttle setting, and for each such setting under a given load, fuel injector timing and ignition timing are varied to determine the optimized operating parameters for the particular throttle setting and load condition. These optimum values are then used as a template in the look-up table. The look-up table templates are stored in a memory (not shown) associated with the computer 26, and depending upon the particular application may include hundreds or tens of thousands of templates providing operating parameters over wide ranges of operation of the engine 2.

As previously indicated for FIGS. 5 and 6, four of the present rotary piston engines 2 are assembled onto a common drive shaft 4 for increasing the power available to rotate the same. Assume for example, that such an assembly of four of the present rotary piston engines 2 are used to power an automobile or vehicle. Note that depending upon a particular vehicle application, the particular sizing of the piston 15, sizing of combustion chamber 12, and fan or blower 6, only one such engine 2, or perhaps a plurality of such engines 2, to a practical limit, may be required to power a particular vehicle, depending upon whether the vehicle is a subcompact automobile or a tractor trailer truck. Regardless, for this example, four of the present rotary piston engines 2 are utilized, as previously mentioned.

The present rotary engine 2 or engines 2, do not have to be placed into an idle mode of operation when a vehicle they are powering is at a stand still. Nor does the present rotary engine 2 require a mechanical starter, as do conventional internal combustion engines. As previously described, when an associated throttle is depressed, the computer 26 will start the associated rotary engine or engines 2, as previously described. In the examples of FIGS. 5 and 6, the computer 26 can be programmed to determine whether one or some combination of the ganged rotary engines 2 will be initially started, whereby the computer 26 programming will be dependent upon the power demanded from the engine 2. For example, the ignition is turned on but the throttle is not depressed, the computer 26 will not send any signals to the engines 2. When the throttle is depressed to at least its first detectable position, computer 26 responds to the associated throttle signals, and selects the corresponding template from the associated look-up table. If at this time computer 26 does not detect any input signals from the various sensors, a start sequence program is initiated. Accordingly, the computer 26 is programmed to select an appropriate template that is representative of a starting template under the detected conditions. In a preferred starting sequence, all four of the ganged rotary piston engines 2 are started as previously indicated for a single such engine 2, and thereafter depending upon signals received from the sensors, the computer 26 will obtain the proper template for operating each one of the four engines 2 as required. In a very low load condition, perhaps only one or two of the ganged engines 2 would actually be operated. Under heavy load conditions, all four of the ganged rotary engines 2 may be operating. As road conditions and throttle settings change, computer 26 will obtain appropriate templates from the look-up table for operating the ganged engines 2, as required. In this example, if the associated vehicle is coming to a stop, application of the vehicle brakes by the driver can be detected for operating purge valves 50 of each of the rotary engines 2 for purging pressure from the combustion chamber 12 (after ignition to prevent pollution problems), and any forthcoming fuel injector 46 and spark plug 48 operation would be immediately terminated. Accordingly, with the vehicle stopped, the engines 2 are rendered inoperative. Also, as previously indicated above, the purge valve 50 can be operated for permitting more rapid or shorter combustion cycles for higher speed operation or higher torque operation.

In summary, as indicated above, an important aspect of the present invention is that via electronic or computerized control of the subject rotary engine 2, the distance the piston 15 travels during power cycles or combustion cycles can readily be changed, in addition a combustion cycle can be initiated independently of the position of piston 15, all of which is unlike standard internal combustion engines with a reciprocating piston, and known rotary piston engines. The less the distance or degrees of rotation of the piston 15 during combustion cycles, the greater the power available.

Also as indicated, in another aspect the present invention utilizing the rotary piston 15, by selecting which ones of the successive pairs of ports are to serve as exhaust ports, and which as intake ports, will determine the direction of rotation of the piston 15. Also, through use of computer controlled timing, the length of travel (degrees of rotation) of the piston 15 can be controlled for directly controlling the length of the power stroke. The more rapidly ignition or combustion cycles occur in given periods of time in the combustion chamber 12, the shorter the power stroke, and vice versa. This is made possible through use of the separate combustion chamber 12, purge valve 50, cam track 17, vanes 38, and computerized control. Also, in yet another aspect of the invention, at startup it does not matter where the piston 15 is positioned. A unique design of the rotary engine 2 ensures that the piston 15 will always start rotating in the same direction. The direction of rotation is determined in the present invention by appropriate selection of alternate pairs of ports as either intake or exhaust port pairings, respectively. Another aspect of the present piston engine 2 design, as indicated above, is that the piston 15 can always be power driven with every combustion cycle, regardless of the position of the piston 15 at the time or combustion. Theoretically, it is believed that maximum power transfer is obtained when combustion occurs with piston 15 positioned as shown in FIG. 15. Accordingly, the present rotary engine 2 can rapidly develop maximum torque from startup because all the combustion chambers can be fired at the same time.

Although various embodiments of the present invention have been shown and described above, they are not meant to be limiting. Those of skill in the art may recognize certain modifications to these embodiments, which embodiments are meant to be covered by the spirit and scope of the appended claims. For example, in an alternate embodiment to the embodiments of FIGS. 7A and 7B, the fan 6 can be electrically driven and free of drive shaft 4. Additionally, as an alternative embodiment to using look-up tables in the programming of computer 26, various algorithms can be developed for computing the necessary timing of combustion cycles, and so forth, from sensor signals received under various operating conditions. Also, a plurality of purge valves 50 can be included for further enhancing the high speed or high torque operation of the engine 2. In yet another alternative embodiment, the engine 2 can include pairs of fuel injectors, one of the injectors being used to inject gasoline into the combustion chamber for ignition, whereafter the other injector injects diesel fuel which is ignited by the superheated gases from the ignition of gasoline.

What I claim is:

1. A rotary piston combustion engine including at least one engine module comprising:

a drive shaft;

a fan including:

a fan housing, said drive shaft being at least partially contained within said fan housing an opening in a front portion of said fan housing permitting air to be drawn therein;

a plurality of spaced apart fan blades rotationally mounted within said fan housing; and means for rotating said plurality of spaced apart fan blades;

a combustion chamber connected at one end to said fan housing, said drive shaft being mounted for rotationally passing through said combustion chamber;

valve means located between said fan housing and said combustion chamber, for permitting air to flow from said fan housing into said combustion chamber, whenever the air pressure in said fan housing is greater than that in said combustion chamber, and for sealing off said combustion chamber from said fan housing, whenever the combustion gas pressure in said combustion chamber is greater than the air pressure in said fan housing;

a piston chamber connected at one end to another end of said combustion chamber, said piston chamber including:

a radially directed convoluted interior wall surface providing a cam track for the length of said chamber;

a plurality of equally spaced apart input ports successively arranged around the circumference of said piston chamber; and a plurality of equally spaced apart exhaust ports successively arranged around the circumference of said piston chamber inbetween each successive two of said plurality of input ports, respectively;

a cylindrical piston rigidly mounted on said drive shaft within said piston chamber, said cylindrical piston including a plurality of spaced apart slots radially oriented and penetrating equally into the circumferential surface of said piston;

a plurality of spring biased vanes partially retained in respective ones of said plurality of slots of said piston, whereby as said piston rotates said vanes follow the contours of the cam track of said piston chamber, causing each of said vanes to reciprocate between extreme extended and retracted positions in rotating between successive exhaust and input ports, a vane being fully extended between successive input and exhaust ports, and fully retracted between successive exhaust and input ports;

a plurality of intake manifolds connected between said plurality of input ports of said piston chamber, respectively, and said combustion chamber, for conveying combustion gases, from said combustion chamber into said piston chamber;

at least one spark plug installed in a wall of said combustion chamber;

at least one fuel injector installed in a wall of said combustion chamber;

a shaft speed sensor mounted proximate said drive shaft, for providing electrical signals indicative of the rotational speed of said drive shaft, and the distance traveled by said piston during given measurement periods; and computerized control means for operating said engine, said computerized control means being programmed for responding to signals from said shaft speed sensor, and to a speed or torque command signal requesting a desired drive shaft RPM or torque, for operating said at least one fuel injector and spark plug to run said engine as required.

2. The rotary piston engine of claim 1, wherein said means for rotating said plurality of spaced apart fan blades includes securing said fan blades to said drive shaft.

3. The rotary piston engine of claim 1, wherein said rotating means includes an electric motor connected to said plurality of fan blades.

4. The rotary piston engine of claim 1, further including:

an exhaust manifold ring;

a plurality of exhaust manifolds connected respectively between said plurality of exhaust ports and said exhaust manifold ring, for conveying exhaust gases from said plurality of exhaust ports into said exhaust manifold ring, respectively; and an exhaust duct connected to said exhaust manifold ring, for exhausting gases therefrom into the atmosphere.

5. The rotary piston engine of claim 1, further including:

a guide shield mounted in said combustion chamber for directing combustion gases from said combustion chamber into said plurality of intake manifolds, respectively.

6. The rotary piston engine of claim 5, further including:

said guide shield being funnel shaped with a centrally located through hole in an otherwise closed relatively wide top portion through which said drive shaft passes, and having a relatively narrow bottom portion, the top portion being proximate to and opposing a portion of an outside wall of said piston chamber;

a first seal bearing through which said drive shaft rotatably passes, said first seal bearing being rigidly attached both via one facial portion to said valve means, and via an opposing facial portion to a bottom end of the narrow bottom portion of said guide shield; and a second seal bearing through which said drive shaft rotatably passes, said second seal bearing being rigidly attached via one facial portion to a central portion of an outer wall of said piston chamber about a through hole thereof, and rigidly attached via a circumferential wall portion in the hole in the top of said guide shield, said guide shield being held stationary via said first and second seal bearings as said drive shaft rotates.

7. The rotary piston engine of claim 1, further including:

a guide shield rigidly attached to said drive shaft within said combustion chamber for rotation to both enhance mixing of injected fuel with air, and direct combustion gases from said combustion chamber into said plurality of intake manifolds.

8. The rotary piston engine of claim 7, further including:

said guide shield being funnel shaped with a centrally located through hole in an otherwise closed relatively wide top portion through which said drive shaft passes and is rigidly attached, and having a relatively narrow bottom portion through which said drive shaft passes, and is rigidly secured thereto.

9. The rotary piston engine of claim 8, further including:

a first seal bearing having a central hole through which said drive shaft rotatably passes, said first seal bearing being rigidly mounted upon and with its central hole concentric with a centrally located hole in an interior wall of said piston chamber, for preventing the passing of combustion gases from said combustion chamber into said piston chamber.

10. The rotary piston engine of claim 9, further including:

said guide shield further including a partial countersunk hole in said top portion for enclosing a portion of said first seal bearing in a non-contacting manner, thereby permitting other portions of said top portion to be in close proximity to an opposing portion of an interior wall of said piston chamber.

11. The rotary piston engine of claim 1, further including:

a combustion pressure sensor mounted in said combustion chamber, for providing combustion pressure signals to said computerized control means;

a fan pressure sensor mounted in said fan housing, for providing fan pressure signals to said computerized control means; and said computerized control means being further programmed to respond to said combustion pressure and fan pressure signals in controlling the operation of said engine.

12. The rotary piston engine of claim 11, further including:

a first temperature transducer mounted in said fan housing, for providing input air temperature signals to said computerized control means;

a second temperature transducer mounted in said combustion chamber, for providing combustion temperature signals to said computerized control means; and said computerized control means being further programmed to respond to said input air and combustion temperature signals in controlling the operation of said engine.

13. The rotary piston engine of claim 1, further including:

at least one purge valve mounted through a wall of said combustion chamber;

said computerized control means being further programmed to operate said purge valve(s) between combustion cycles to purge gases from said combustion chamber, preparatory for a next combustion cycle to enhance high speed operation or high torque 6 operation of said engine.

14. The rotary piston engine of claim 1, further including:

a pair of spaced apart countersunk holes in the bottom of each one of said plurality of slots, respectively, in said piston;

a plurality of springs each one of which is individually installed in the bottom portion of said countersunk holes in said plurality of slots, respectively; and said plurality of spring biased vanes each having a top edge portion for sealing against and following said cam track, and a pair of spaced apart spring guide arms configured to slidably fit into associated one of said plurality of slots of said piston, said spring guide arms having bottom portions in constant contact with top portions of associated ones of said plurality of springs, for spring biasing said plurality of vanes in a manner permitting each vane to reciprocate in following said cam track as said piston rotates.

15. The rotary piston engine of claim 1, further including a plurality of datum marks permanently placed on said drive shaft; and said shaft speed sensor being positioned relative to said drive shaft for detecting the passage of said plurality of datum marks, respectively, for providing signals to said computerized control means for counting the number of datum marks detected over a given measuring period for determining the distance the piston travels during the measurement period relative to the termination of a combustion or power cycle, whereafter a new combustion or power cycle can be initiated.

16. The rotary piston engine of claim 15, further including:

said plurality of spring biased vanes being sixteen in number, and equally spaced apart;

said plurality of intake ports being four in number;

said plurality of exhaust ports being four in number; and said cam track including:

four equally spaced apart first lobes each bearing a relative maximum radial length from the center of said piston chamber midway between each successive intake port and exhaust port, at which points opposing ones of said plurality of spring biased vanes will be in their fully extended positions; and four equally spaced apart second lobes inbetween said first lobes, said second lobes each having a relative minimum radial length from the center of said piston chamber midway between each successive exhaust port and intake port, at which point opposing ones of said plurality of spring biased vanes will be in their fully retracted positions.

17. The rotary piston of claim 1, wherein said valve means includes:

a valve plate rigidly connected between an open interior end portion of said fan housing, and an open end of said combustion chamber, said valve plate including a plurality of through holes for passing air from said fan housing into said combustion chamber; and a shutter disk rigidly mounted in said combustion chamber proximate said valve plate, said shutter disk including a plurality of shutter flaps opposing each of said plurality of air passage holes in said valve plate, respectively, whereby whenever the air pressure in said combustion chamber exceeds the air pressure in said fan housing, said shutter flaps move in a manner to close off said plurality of air passage holes, thereby preventing the flow of air and combustion gases between said combustion chamber and fan housing, said plurality of shutter flaps being positioned away from said plurality of air passage holes at other times.

18. The rotary piston of claim 1, wherein said valve means includes a cage valve plate rigidly connected between an open interior end of said fan housing, and an open end of said combustion chamber; and a plurality of cage ball valves arranged on said cage ball valve plate, operative for permitting the passage of air from said fan housing into said combustion chamber whenever the air pressure in said fan housing exceeds the pressure in said combustion chamber, and for blocking such passage of air and combustion gases therebetween whenever the combustion gas pressure in said combustion chamber exceeds the air pressure in said fan housing.

19. The rotary piston engine of claim 1, wherein said computerized control means is further programmed to utilize templates of a look-up table for deriving from sensed signals necessary control signals to run said engine.

20. The rotary piston engine of claim 19, wherein said computerized control means is further programmed to sense a malfunctioning engine module, and respond by terminating its operation while continuing operation of the other ones of said plurality of said engine modules.

21. The rotary piston engine of claim 1, further including:

a plurality of said engine modules ganged together on a common drive shaft; and each being controlled by a common computerized control means programmed to operate ganged array of engine modules.

22. A rotary piston engine comprising:

a drive shaft;

a fan enclosed within a fan housing;

a plurality of engine modules ganged together on said drive shaft;

each one of said plurality of engine modules including:

a combustion chamber connected at one end to said fan housing, said drive shaft being mounted for rotationally passing through said combustion chamber;

valve means located between said fan housing and said combustion chamber, for permitting air to flow from said fan housing into said piston chamber, whenever the air pressure in said fan housing is greater than that in said combustion chamber, and for sealing off said combustion chamber from said fan housing, whenever the combustion gas pressure in said combustion chamber is greater than the air pressure in said fan housing;

a piston chamber connected at one end to another end of said combustion chamber, said piston chamber including:

a radially directed convoluted interior wall surface providing a cam track for the length of said chamber;

a plurality of equally spaced apart input ports successively arrange around the circumference of said piston chamber; and a plurality of equally spaced apart exhaust ports successively arranged around the circumference of said piston chamber inbetween each successive two of said plurality of input ports, respectively;

a cylindrical piston rigidly mounted on said drive shaft within said piston chamber, said cylindrical piston including a plurality of spaced apart slots radially oriented and penetrating equally into the circumferential surface of said piston;

a plurality of spring biased vanes partially retained in respective ones of said plurality of slots of said piston, whereby as said piston rotates said vanes follow the contours of the cam track of said piston chamber, causing each of said vanes to reciprocate between extreme extended and retracted positions in rotating between successive exhaust and input ports, a vane being fully extended between successive input and exhaust ports, and fully retracted between successive exhaust and input ports;

a plurality of intake manifolds connected between said plurality of input ports of said piston chamber, respectively, and said combustion chamber, for conveying combustion gases, from said combustion chamber into said piston chamber;

at least one spark plug installed in a wall of said combustion chamber; and at least one fuel injector installed in a wall of said combustion chamber;

a shaft speed sensor mounted proximate said drive shaft, for providing electrical signals indicative of the rotational speed of said drive shaft, and the distance traveled by said piston during given measurement periods; and computerized control means for operating said engine, said computerized control means being programmed for responding to signals from said shaft speed sensor, and to a speed or torque command signal requesting a desired drive shaft RPM or torque, for operating said at least one fuel injector and spark plug of each one of said plurality of engine modules to run said engine as required.

23. The rotary piston engine of claim 22, wherein said computerized control means is further programmed to sense a malfunctioning engine module, and respond by terminating said malfunctioning engine module operation while continuing operation of the other ones of said plurality of said engine modules.

* * * * *